US010151439B2

(12) United States Patent
Woodward

(10) Patent No.: US 10,151,439 B2
(45) Date of Patent: Dec. 11, 2018

(54) DUAL BEAM HEADLAMP

(71) Applicant: Magna International, Inc., Aurora (CA)

(72) Inventor: Ronald O. Woodward, Yorktown, VA (US)

(73) Assignee: Magna International Inc., Aurora (CA)

( * ) Notice: Subject to any disclaimer, the term of this patent is extended or adjusted under 35 U.S.C. 154(b) by 270 days.

(21) Appl. No.: 14/912,792

(22) PCT Filed: Aug. 18, 2014

(86) PCT No.: PCT/US2014/051511

§ 371 (c)(1),
(2) Date: Feb. 18, 2016

(87) PCT Pub. No.: WO2015/026730

PCT Pub. Date: Feb. 26, 2015

(65) Prior Publication Data

US 2016/0201865 A1 Jul. 14, 2016

Related U.S. Application Data

(60) Provisional application No. 61/867,327, filed on Aug. 19, 2013.

(51) Int. Cl.
*B60Q 1/14* (2006.01)
*F21S 8/10* (2006.01)
(Continued)

(52) U.S. Cl.
CPC ..... *F21S 48/125* (2013.01); *F21S 41/141* (2018.01); *F21S 41/147* (2018.01); *F21S 41/19* (2018.01);
(Continued)

(58) Field of Classification Search
CPC ..... F21S 41/32; F21S 41/265; F21S 41/663; F21S 41/36; F21S 41/295; F21S 41/147; F21S 41/141; F21S 41/19; F21S 41/255
See application file for complete search history.

(56) References Cited

U.S. PATENT DOCUMENTS 1,533,615 A 4/1925 Schwartz
1,642,917 A 9/1927 Zimmermann et al.
(Continued)

FOREIGN PATENT DOCUMENTS

DE 2644385 A1 4/1978
EP 1970617 A1 9/2008
(Continued)

*Primary Examiner* — Elmito Breval
(74) *Attorney, Agent, or Firm* — Harness, Dickey & Pierce, P.L.C.

(57) ABSTRACT

A headlamp assembly for projecting light in a forward direction along an optical axis is provided. The headlamp assembly may include a housing, a low beam light emitting device, a high beam light emitting device, a low beam lens, a high beam lens, and a reflector. The low beam and high beam light emitting devices may be arranged in the housing and include first and second planar surfaces, respectively, from which light is emitted. The normal to the first and second planar surfaces may be oriented away from the optical axis at substantially forty-five degrees in relation to the optical axis. The normal to the second planar surface may be oriented away from the normal to the first planar surface at substantially ninety degrees.

20 Claims, 21 Drawing Sheets

(51) Int. Cl.

| | |
|---|---|
| ***F21S 41/19*** | (2018.01) |
| ***F21S 41/141*** | (2018.01) |
| ***F21S 41/147*** | (2018.01) |
| ***F21S 41/29*** | (2018.01) |
| ***F21S 41/25*** | (2018.01) |
| ***F21S 41/255*** | (2018.01) |
| ***F21S 41/265*** | (2018.01) |
| ***F21S 41/32*** | (2018.01) |
| ***F21S 41/33*** | (2018.01) |
| ***F21S 41/36*** | (2018.01) |
| ***F21S 41/663*** | (2018.01) |

(52) U.S. Cl.
CPC ..... *F21S 41/25* (2018.01); *F21S 41/255* (2018.01); *F21S 41/265* (2018.01); *F21S 41/295* (2018.01); *F21S 41/32* (2018.01); *F21S 41/336* (2018.01); *F21S 41/36* (2018.01); *F21S 41/663* (2018.01)

(56) References Cited

U.S. PATENT DOCUMENTS

| | | | | |
|---|---|---|---|---|
| 5,313,379 | A | 5/1994 | Lemons et al. | |
| 5,954,427 | A | 9/1999 | Campos et al. | |
| 6,926,432 | B2 | 8/2005 | Rodriguez Barros et al. | |
| 7,264,387 | B1 | 9/2007 | McCarter et al. | |
| 7,275,846 | B2 | 10/2007 | Browne et al. | |
| 8,038,334 | B2 * | 10/2011 | Ishida | F21S 41/147 362/539 |
| 8,573,803 | B2 | 11/2013 | Satou et al. | |
| 2004/0184280 | A1 | 9/2004 | Ishida et al. | |
| 2005/0018428 | A1 | 1/2005 | Harvey | |
| 2005/0068787 | A1 * | 3/2005 | Ishida | B60Q 1/14 362/538 |
| 2008/0117327 | A1 | 5/2008 | Nishizawa et al. | |
| 2008/0117627 | A1 | 5/2008 | Lu et al. | |
| 2008/0225540 | A1 | 9/2008 | Tsukamoto et al. | |
| 2008/0285297 | A1 | 11/2008 | Ishida | |
| 2008/0316760 | A1 | 12/2008 | Schug et al. | |
| 2010/0123881 | A1 | 5/2010 | Sakata | |
| 2010/0246203 | A1 | 9/2010 | Chen et al. | |
| 2012/0051063 | A1 | 3/2012 | Holder | |
| 2012/0262935 | A1 * | 10/2012 | Yamamoto | B60Q 1/14 362/516 |
| 2013/0083553 | A1 * | 4/2013 | Sekiguchi | B60Q 1/0041 362/517 |
| 2013/0120988 | A1 | 5/2013 | Woodward | |
| 2013/0215635 | A1 | 8/2013 | Boyd, Jr. et al. | |
| 2014/0063816 | A1 | 3/2014 | Seki et al. | |

FOREIGN PATENT DOCUMENTS

| | | | |
|---|---|---|---|
| EP | 2386795 | A1 | 11/2011 |
| JP | 2005108554 | A | 4/2005 |
| JP | 2006164735 | A | 6/2006 |
| JP | 2008226788 | A | 9/2008 |
| JP | 2008300154 | A | 12/2008 |
| JP | 2009094014 | A | 4/2009 |
| JP | 2009129572 | A | 6/2009 |
| JP | 2010067380 | A | 3/2010 |
| WO | WO-2012138962 | A1 | 10/2012 |
| WO | WO-2012138962 | A1 | 2/2015 |

* cited by examiner

DUAL BEAM HEADLAMP

CROSS-REFERENCE TO RELATED APPLICATIONS

This application is a 371 National Phase of PCT/US2014/051511, filed on Aug. 18, 2014 and published as WO 2015/026730 A1 on Feb. 26, 2015, which claims the benefit of U.S. Provisional Application No. 61/867,327, filed on Aug. 19, 2013. The entire disclosures of the above applications are incorporated herein by reference.

FIELD

The present disclosure relates to an improved dual beam headlamp assembly.

BACKGROUND

Headlamps or headlights are often used in automobiles, and other motorized vehicles, to control and focus light in a desired direction. The light may be produced by an incandescent bulb, a halogen bulb, a light emitting diode (LED) or other light source and transmitted to and from a series of reflectors and/or lens, prior to being delivered to the path of the vehicle. Some headlamps suffer from low optical efficiency, high cost, or poor beam pattern distribution. In order to improve the performance and efficiency of a headlamp assembly, it may be desirable to maximize the amount of light that is directed in the desired direction, and minimize the amount of light that is lost to the surroundings.

This section provides background information related to the present disclosure which is not necessarily prior art.

SUMMARY

This section provides a general summary of the disclosure, and is not a comprehensive disclosure of its full scope or all of its features.

A headlamp assembly for projecting light in a forward direction along an optical axis is provided. The headlamp assembly include: a housing, a low beam light emitting device, a high beam light emitting device, a low beam lens, a high beam lens, and a reflector. The low beam and high beam light emitting devices may be arranged in the housing and include first and second planar surfaces, respectively, from which light is emitted. The normal to the first and second planar surfaces may be oriented away from the optical axis at substantially forty-five degrees in relation to the optical axis. The normal to the second planar surface may be oriented away from the normal to the first planar surface at substantially ninety degrees. The low beam and high beam lens may be arranged in the housing to receive a portion of the light emitted from the low beam and high beam light emitting devices, respectively, and operable to direct the light in the forward direction along the optical axis. The reflector may be arranged in the housing to receive a remaining portion of the light emitted from the low beam and high beam light emitting devices and reflect the remaining portion of the light in the forward direction along the optical axis.

The low beam lens can include a first planar lens surface and the high beam lens can include a second planar lens surface, such that the first planar lens surface is oriented from the first planar surface of the low beam light source at substantially forty-five degrees and the second planar lens surface is oriented from the second planar surface of the high beam light source at substantially forty-five degrees.

The headlamp assembly may further include a leg, wherein the low beam lens is mounted to a first side of the leg and the high beam lens is mounted to a second side of the leg, opposite the first side.

The headlamp assembly further includes a bracket having a first mount surface and a second mount surface, wherein an angle between the first mount surface and the second mount surface is substantially equal to ninety degrees, and the low beam light emitting device is disposed on the first mount surface and the low beam light emitting device is disposed on the second mount surface.

The reflector can include a low beam portion and a high beam portion, wherein the low beam portion is positioned above the low beam lens and the low beam light emitting device in relation to the optical axis and has a reflecting surface with a shape obtained by revolving a parabola ninety degrees around its axis, and the high beam portion is positioned below the high beam lens and the high beam light emitting device in relation to the optical axis and has a reflecting surface with a shape obtained by revolving a parabola ninety degrees around its axis. The reflecting surface of the low beam portion and the high beam portion of the reflector can be comprised of a plurality of reflecting surfaces, where each reflecting surface has a parabolic shape.

The low beam portion and the high beam portion of the reflector define an aperture therebetween, wherein the low beam light emitting device and the high beam light emitting device are disposed substantially within the aperture.

According to another particular aspect, a headlamp assembly for projecting light in a forward direction along an optical axis is provided. The headlamp assembly include: a housing, a low beam light emitting device, a low beam lens, a high beam light emitting device, a high beam lens, a reflector, and a bracket. The housing defines an aperture therein. The low beam light emitting device is arranged in the housing and has a planar surface from which light is emitted. The low beam lens is arranged in the housing to receive a portion of the light emitted from the low beam light emitting device and is operable to direct the light in the forward direction along the optical axis. The high beam light emitting device is arranged in the housing and has a planar surface from which light is emitted. The high beam lens is arranged in the housing to receive a portion of the light emitted from the high beam light emitting device and is operable to direct the light in the forward direction along the optical axis. The reflector is arranged in the housing to receive a remaining portion of the light emitted from the low beam light emitting device and the high beam light emitting device. The reflector is also arranged to reflect the remaining portion of the light in the forward direction along the optical axis. The normal to the planar surface of the low beam light emitting device is orientated in relation to the normal of the planar surface of the high beam light emitting device in a manner that creates a space within the housing in which light from the low beam light emitting device and from the high beam light emitting device does not pass through. The bracket is disposed in the space within the housing in which light from the low beam light emitting device and from the high beam light emitting device does not pass through. The low beam lens and the high beam lens are attached to the bracket. The low beam light emitting device and the high beam light emitting device can also be disposed substantially in the space The low beam lens may be formed in shape of a cylinder cut in half along a longitudinal axis thereof to define a flat surface opposing a curved surface, such that the flat surface is arranged to receive the portion of the light emitted from the low beam light emitting device; whereas, the high beam lens may be formed in shape of a cylinder cut in half along a longitudinal axis thereof to define a flat surface opposing a curved surface, such that the flat surface is arranged to receive the portion of the light emitted from the high beam light emitting device. The flat surface of the low beam lens is preferably oriented at substantially forty-five degrees in relation to the planar surface of the low beam light emitting device, and the flat surface of the high beam lens is preferably oriented at substantially forty-five degrees in relation to the planar surface of the high beam light emitting device.

The reflector includes a low beam portion and a high beam portion. The low beam portion is positioned above the low beam lens and the low beam light emitting device in relation to the optical axis and has a reflecting surface with a shape obtained by revolving a parabola ninety degrees around its axis. Likewise, the high beam portion is positioned below the high beam lens and the high beam light emitting device in relation to the optical axis and has a reflecting surface with a shape obtained by revolving a parabola ninety degrees around its axis.

The low beam portion of the reflector can include a plurality of reflecting surfaces, such that each reflecting surface has a different focal point on the planar surface of the low beam light emitting device and the high beam portion of the reflector has a plurality of reflecting surfaces, such that each reflecting surface has a different focal point on the planar surface of the high beam light emitting device. In some embodiments, the reflector can be configured such that light is only reflected once off a surface thereof.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 1 is a perspective view of a dual beam headlamp assembly, in accordance with the principles of the present disclosure;

FIG. 2*a* is a cross-sectional side view of the dual beam headlamp assembly of FIG. 1 taken along the line 2*a*-2*a*, showing the ray traces produced by a series of reflectors;

FIG. 2*b* is a cross-sectional side view of the dual beam headlamp assembly of FIG. 1 taken along the line 2*a*-2*a*, showing the ray traces produced by a first lens and a second lens;

FIG. 3*a* is a cross-sectional top view of the dual beam headlamp assembly of FIG. 1 taken along the line 3*a*-3*a*, with the first lens and the second lens removed;

FIG. 3*b* is a cross-sectional top view of the dual beam headlamp assembly of FIG. 1 taken along the line 3*b*-3*b*, showing the first lens;

FIG. 3*c* is a cross-sectional top view of the dual beam headlamp assembly of FIG. 1 taken along the line 3*b*-3*b*, showing the first lens and the ray traces produced by the series of reflectors;

FIG. 3*d* is a cross-sectional top view of the dual beam headlamp assembly of FIG. 1 taken along the line 3*b*-3*b*, showing the first lens and the ray traces produced by segments of the first lens;

FIG. 3*e* is a cross-sectional top view of the dual beam headlamp assembly of FIG. 1 taken along the line 3*b*-3*b*, showing the first lens and the ray traces produced by a segment of the first lens;

FIG. 4*a* is a cross-sectional bottom view of the dual beam headlamp assembly of FIG. 1 taken along the line 4*a*-4*a*, with the first lens and the second lens removed;

FIG. 4*b* is a cross-sectional bottom view of the dual beam headlamp assembly of FIG. 1 taken along the line 4*b*-4*b*, showing the second lens;

FIG. 4*c* is a cross-sectional top view of the dual beam headlamp assembly of FIG. 1 taken along the line 4*b*-4*b*, showing the second lens and the ray traces produced by the series of reflectors;

FIG. 4*d* is a cross-sectional top view of the dual beam headlamp assembly of FIG. 1 taken along the line 4*b*-4*b*, showing the second lens and the ray traces produced by segments of the second lens;

FIG. 4*e* is a cross-sectional top view of the dual beam headlamp assembly of FIG. 1 taken along the line 4*b*-4*b*, showing the second lens and the ray traces produced by a segment of the second lens;

Figure 1:
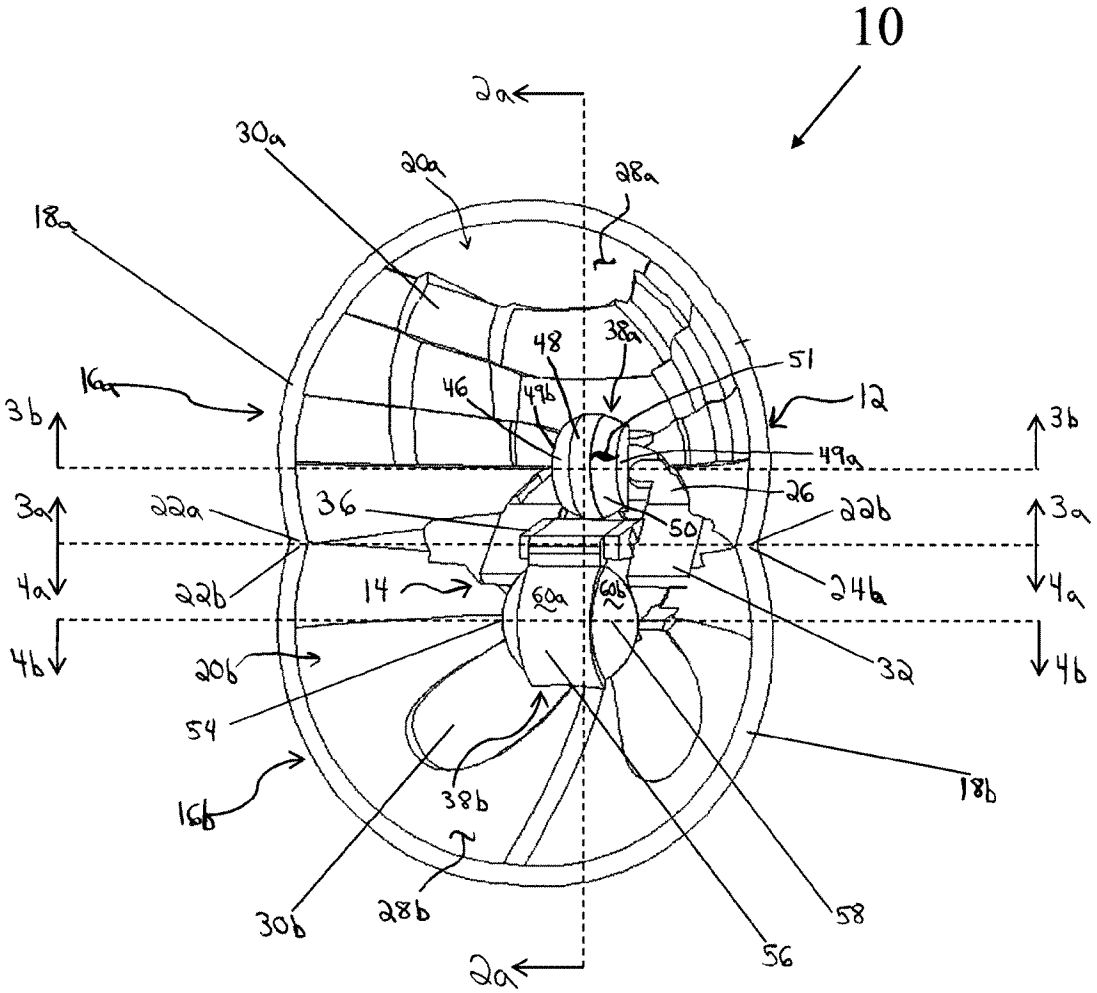
Figure 8A:
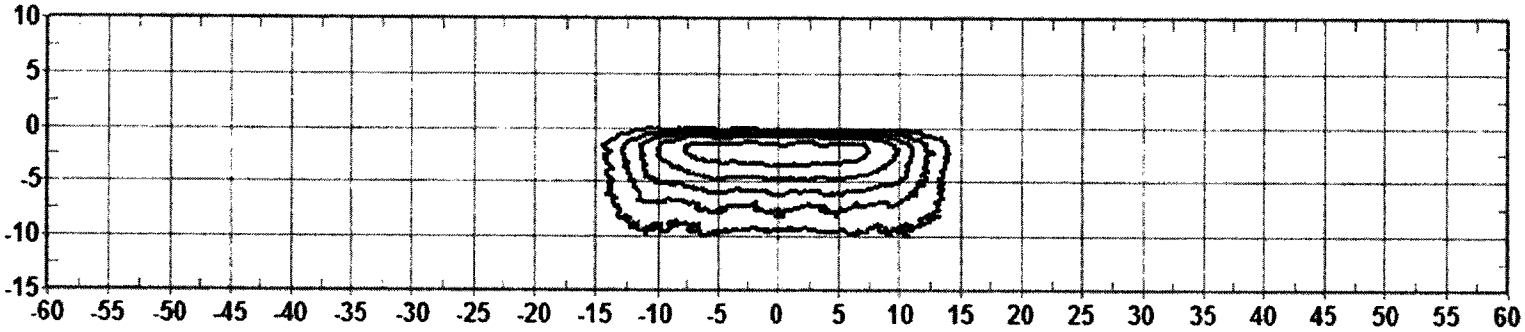
Figure 8B:
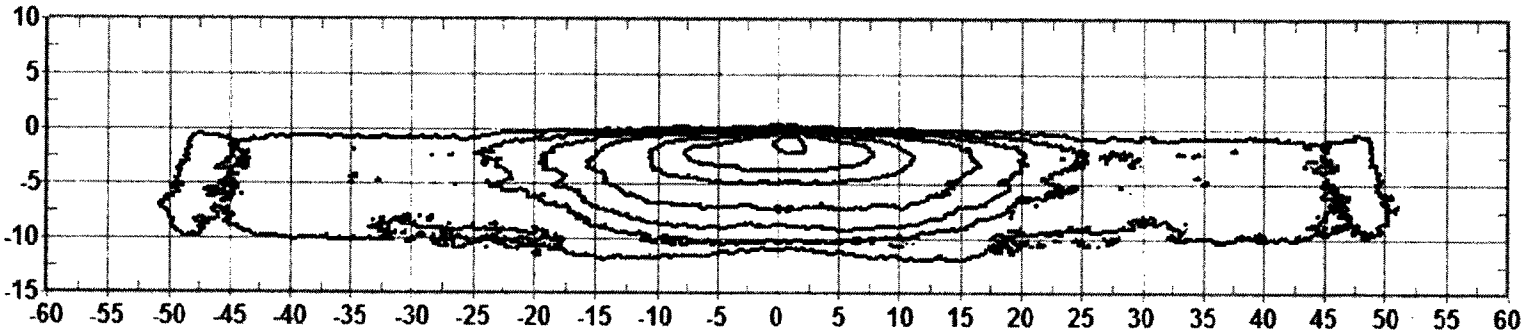
Figure 8C:
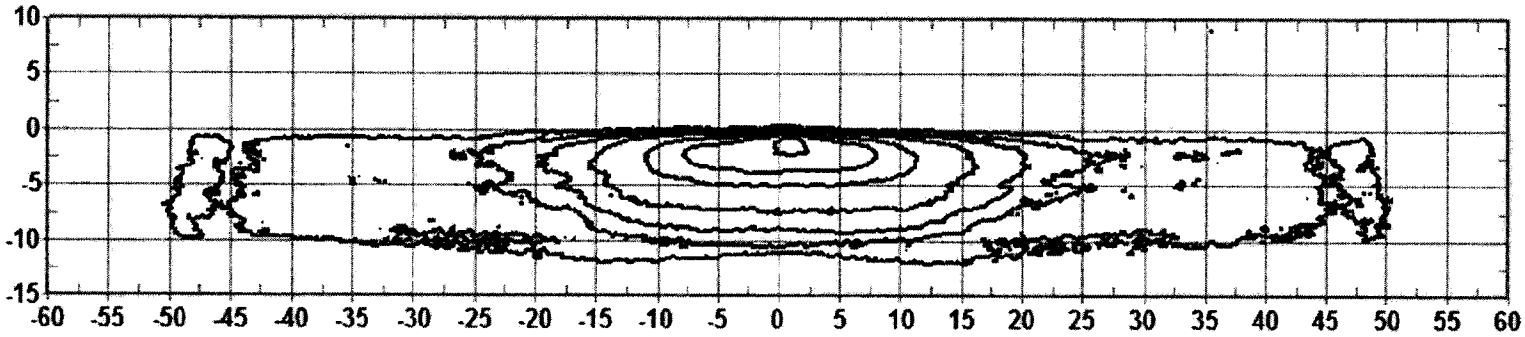

FIG. 8*a* is an illustration of the light pattern produced by the first lens of the dual beam headlamp assembly of FIG. 1;

FIG. 8*b* is an illustration of the light pattern produced by a first series of reflectors of the dual beam headlamp assembly of FIG. 1;

FIG. 8*c* is an illustration of the light pattern produced by the first lens and the first series of reflectors of FIGS. 8*a* and 8*b;*

Figure 9A:
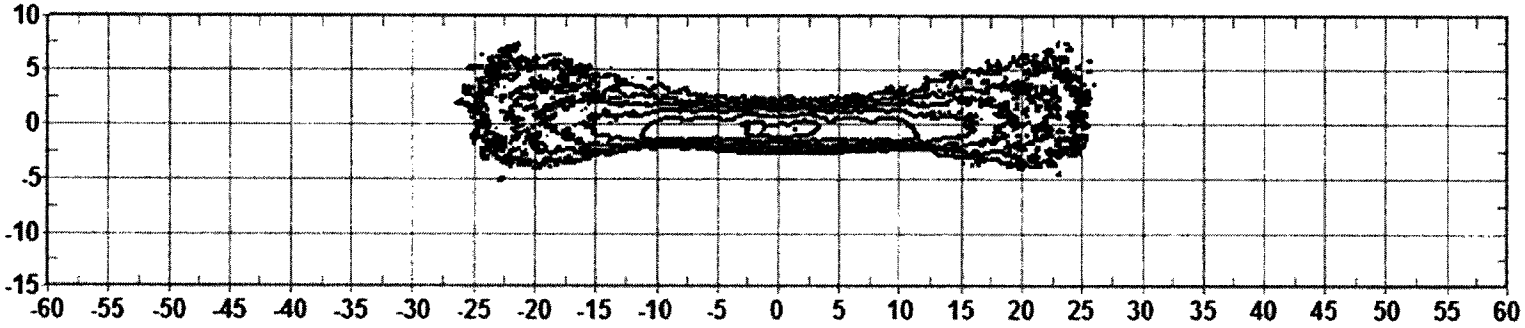
Figure 9B:
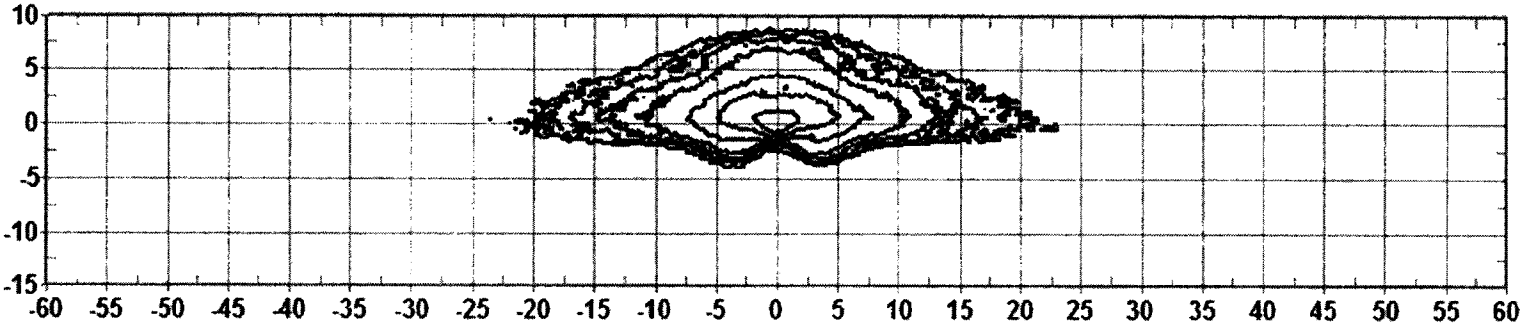
Figure 9C:
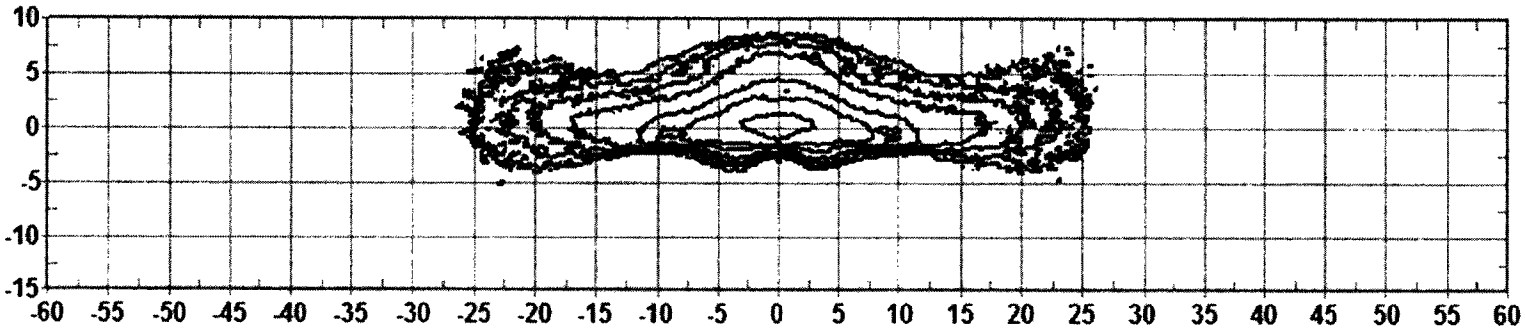
Figure 10:
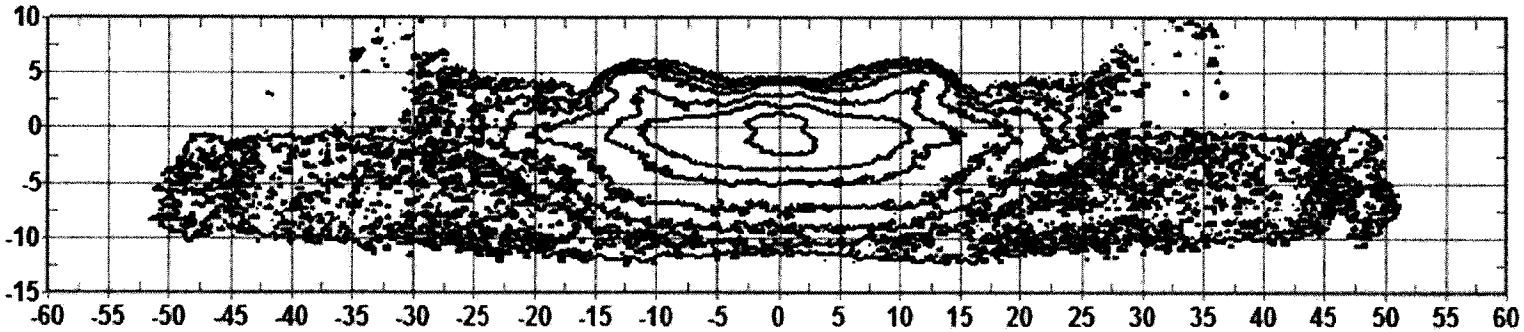

FIG. 9*a* is an illustration of the light pattern produced by the second lens of the dual beam headlamp assembly of FIG. 1;

FIG. 9*b* is an illustration of the light pattern produced by a second series of reflectors of the dual beam headlamp assembly of FIG. 1;

FIG. 9*c* is an illustration of the light pattern produced by the second lens and the second series of reflectors of FIGS. 9*a* and 9*b*; and FIG. 10 is an illustration of the light pattern produced by the first and second lens and first and second series of reflectors of FIGS. 8*c* and 9*c*.

Corresponding reference numerals indicate corresponding parts throughout the several views of the drawings.

DETAILED DESCRIPTION

Example embodiments will now be described more fully with reference to the accompanying drawings.

Figure 2A:
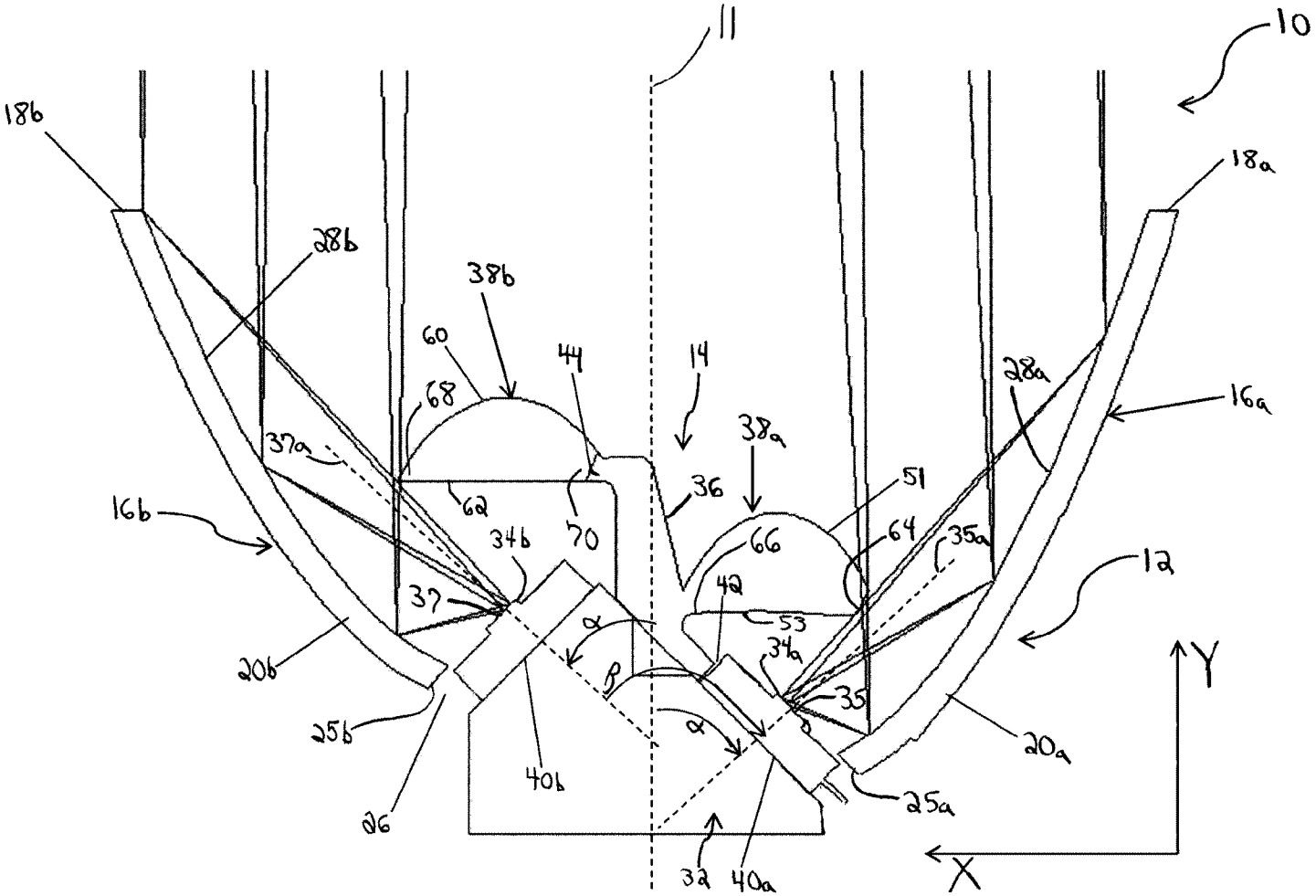

With reference to the figures, a headlamp assembly 10 is provided and may include a reflector subassembly 12 and an illuminator subassembly 14. The headlamp assembly 10 may be used to project light in a forward direction along an optical axis 11 (FIG. 2*a*). The reflector subassembly 12 may include a first portion 16*a* and a second portion 16*b*. It will be appreciated that, while the reflector subassembly 12 is described as including separate first and second portions 16*a*, 16*b*, the first and second portions 16*a*, 16*b* may be integrally formed as part of a unitary reflector subassembly 12. The first and second portions 16*a*, 16*b* may include substantially arcuate shell portions 20*a*, 20*b*, respectively, having an arcuate rim portion 18*a*, 18*b* at a distal end thereof. The rim portions 18*a*, 18*b* may extend from a first end 22*a*, 22*b* to a second end 24*a*, 24*b*, respectively, and may be integrally formed with the shell portions 20*a*, 20*b*.

Each shell portion 20*a*, 20*b* may include a recessed portion 25*a*, 25*b*, respectively, at a proximal end thereof, opposite the rim portion 18*a*, 18*b*. The first and second portions 16*a*, 16*b* may be arranged in a variety of configurations to control the direction of light emitted from the headlamp assembly 10. With particular reference to FIG. 1, in the example embodiment, the first end 22*a* of the rim portion 18*a* may extend from the first end 22*b* of the rim portion 18*b*, and the second end 24*a* of the rim portion 18*a* may extend from the second end 22*b* of the rim portion 18*b*, such that the rim portions 18*a*, 18*b* may substantially form the shape of a confocal parabolic cylinder, resembling the shape of an "8," and the recessed portions 25*a*, 25*b* may cooperate to form an aperture 26 in the reflector subassembly 12. In an alternative embodiment, the first and second portions 16*a*, 16*b* may be arranged in a side-by-side configuration, such that the first end 22*a* of the rim portion 18*a* is adjacent to the first end 22*b* of the rim portion 18*b*, and the first and second portions 16*a*, 16*b* substantially form the shape of a "W." In another alternative embodiment, the arcuate portion of rim portion 18*a* may be adjacent to the arcuate portion of rim portion 18*b*, such that the first and second portions 16*a*, 16*b* substantially form the shape of an "X."

Figure 3A:
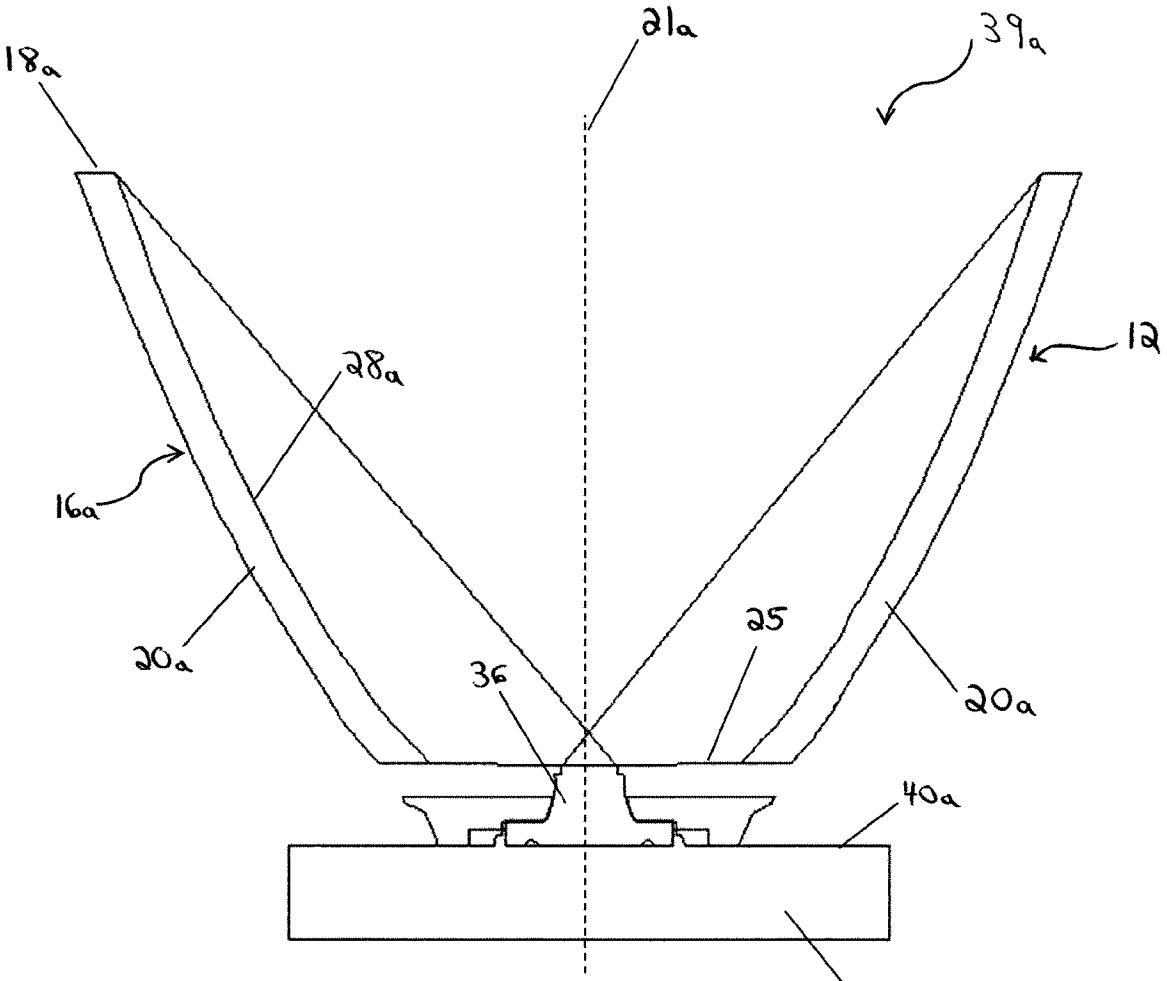
Figure 3B:
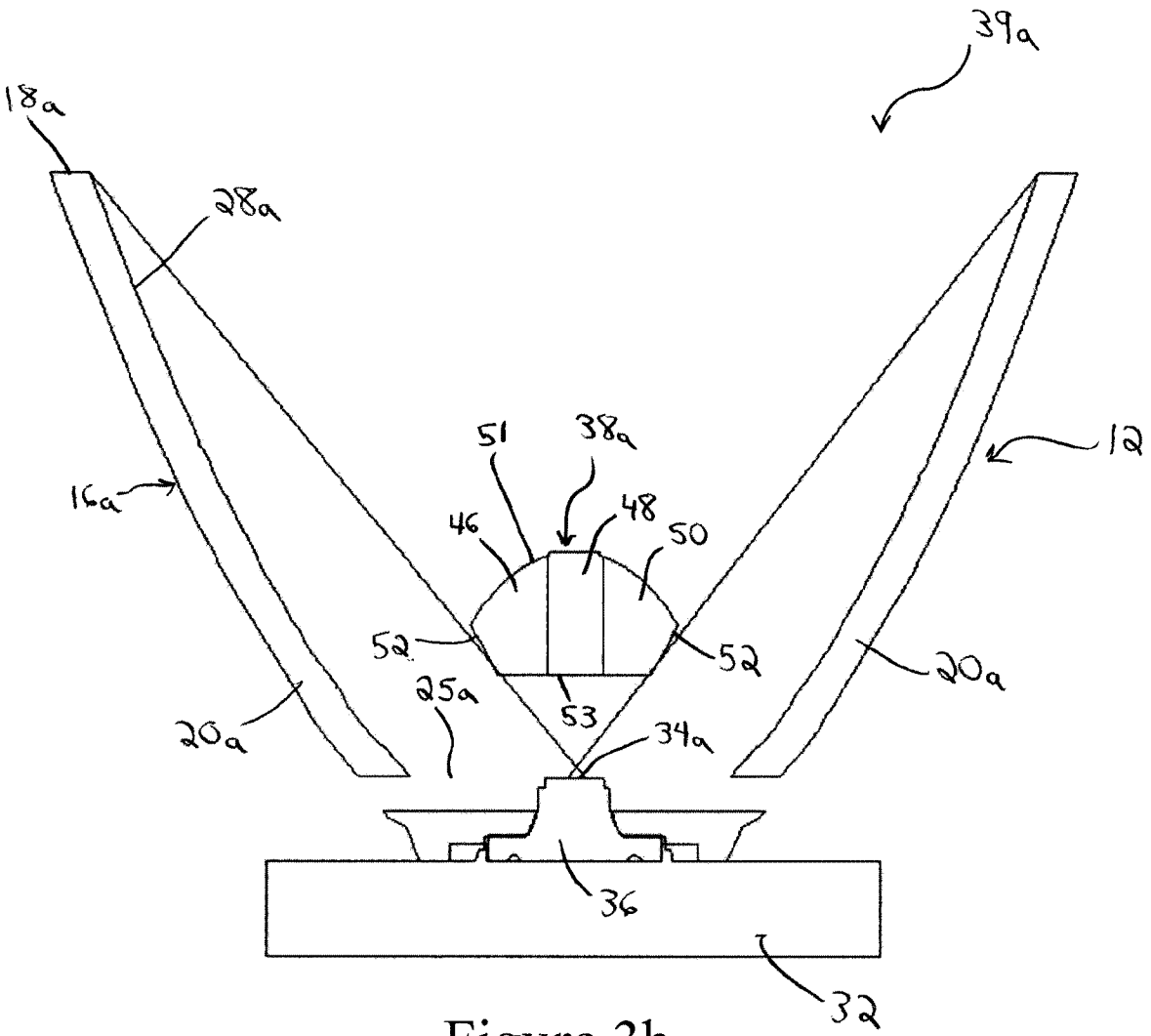
Figure 4A:
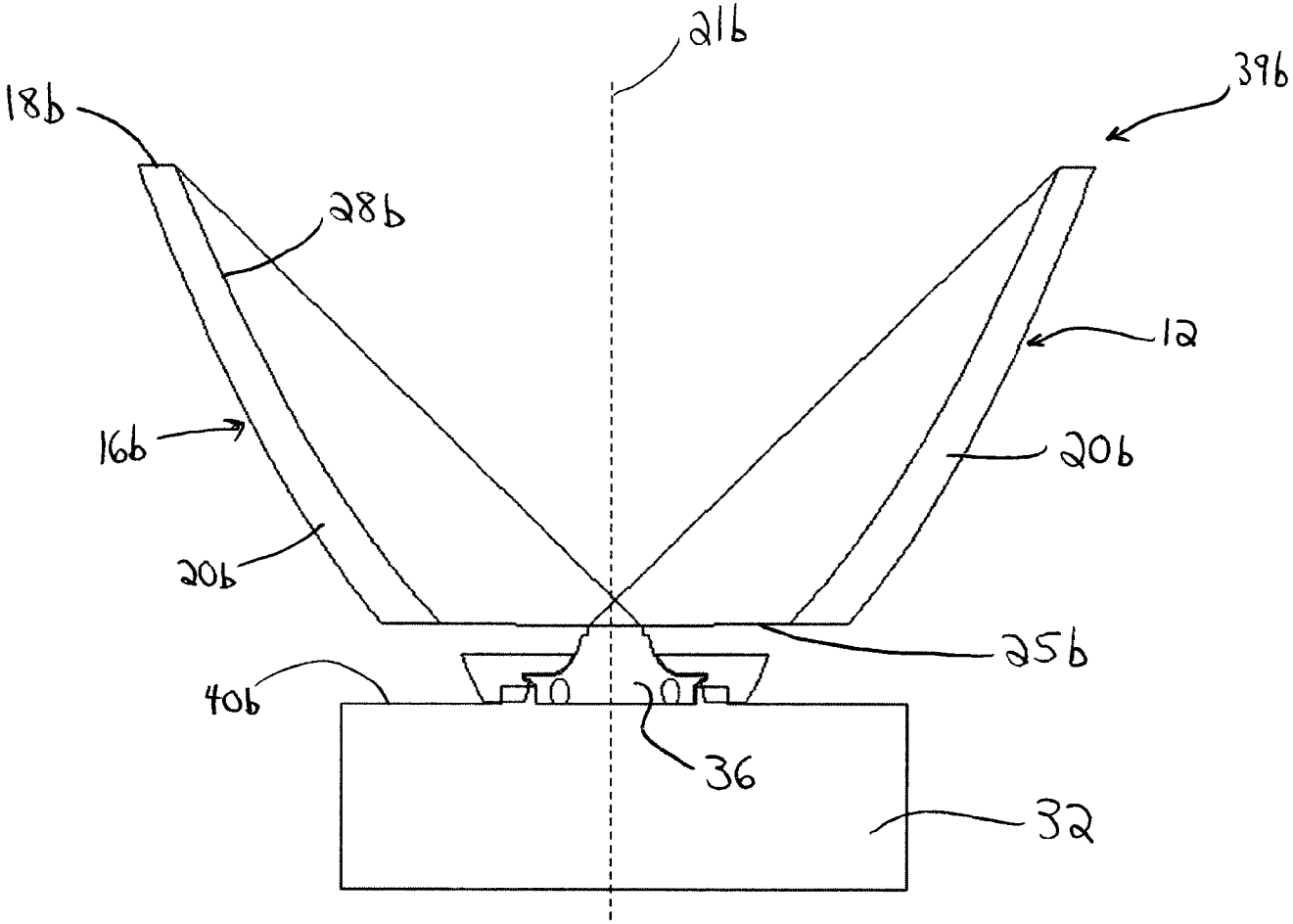
Figure 4B:
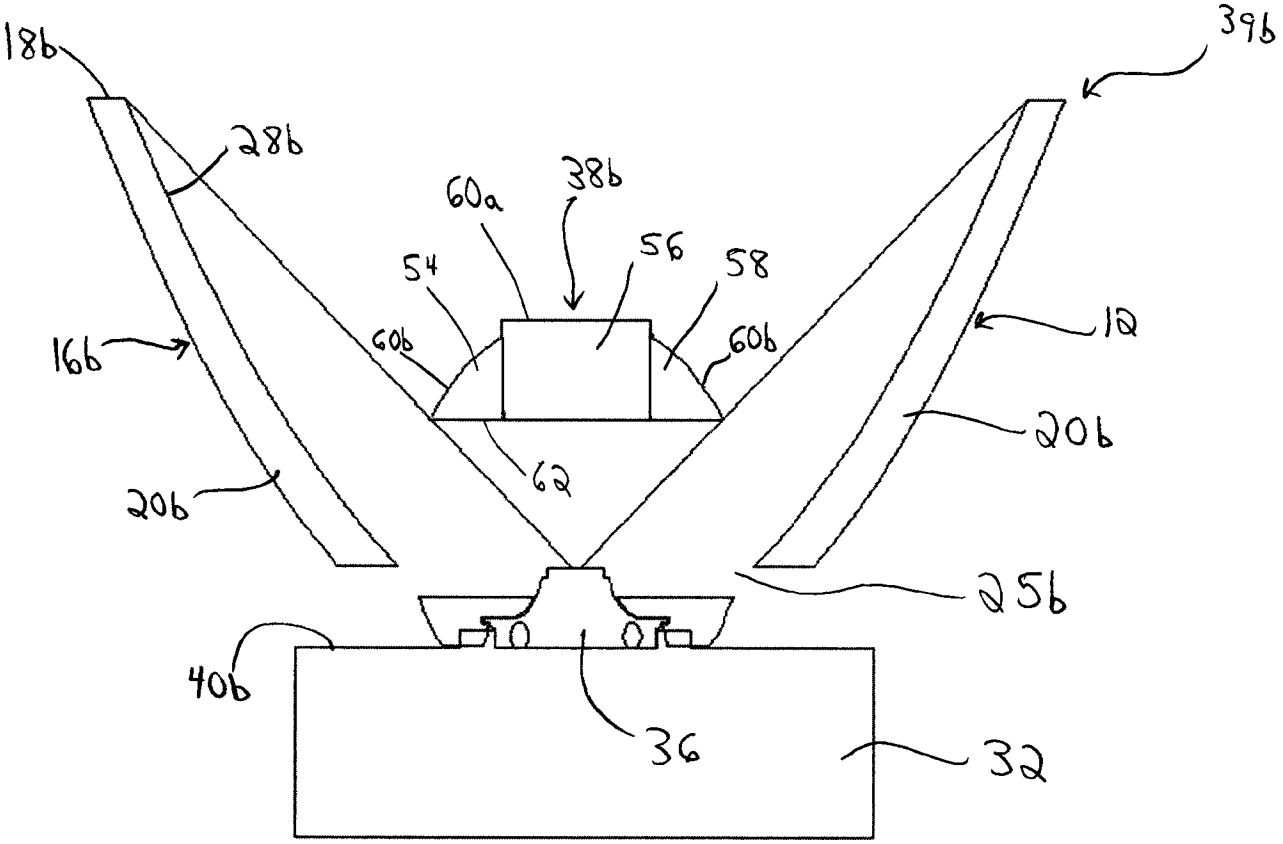
Figure 4C:
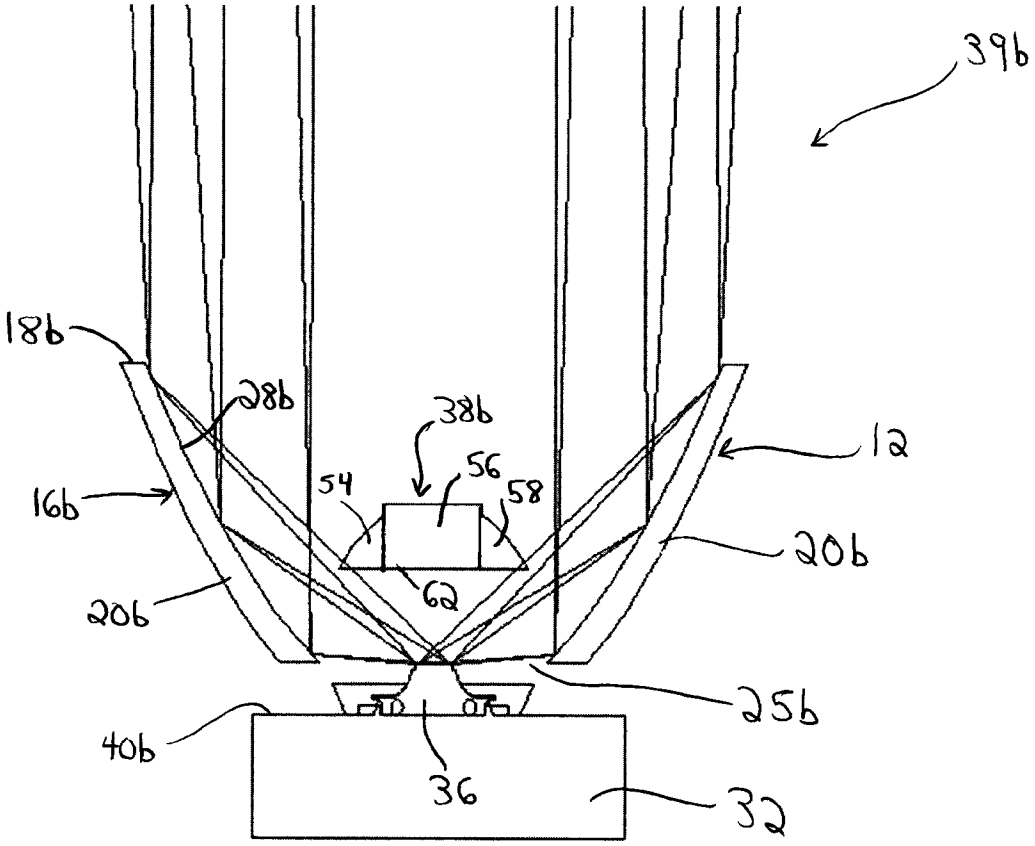
Figure 5:
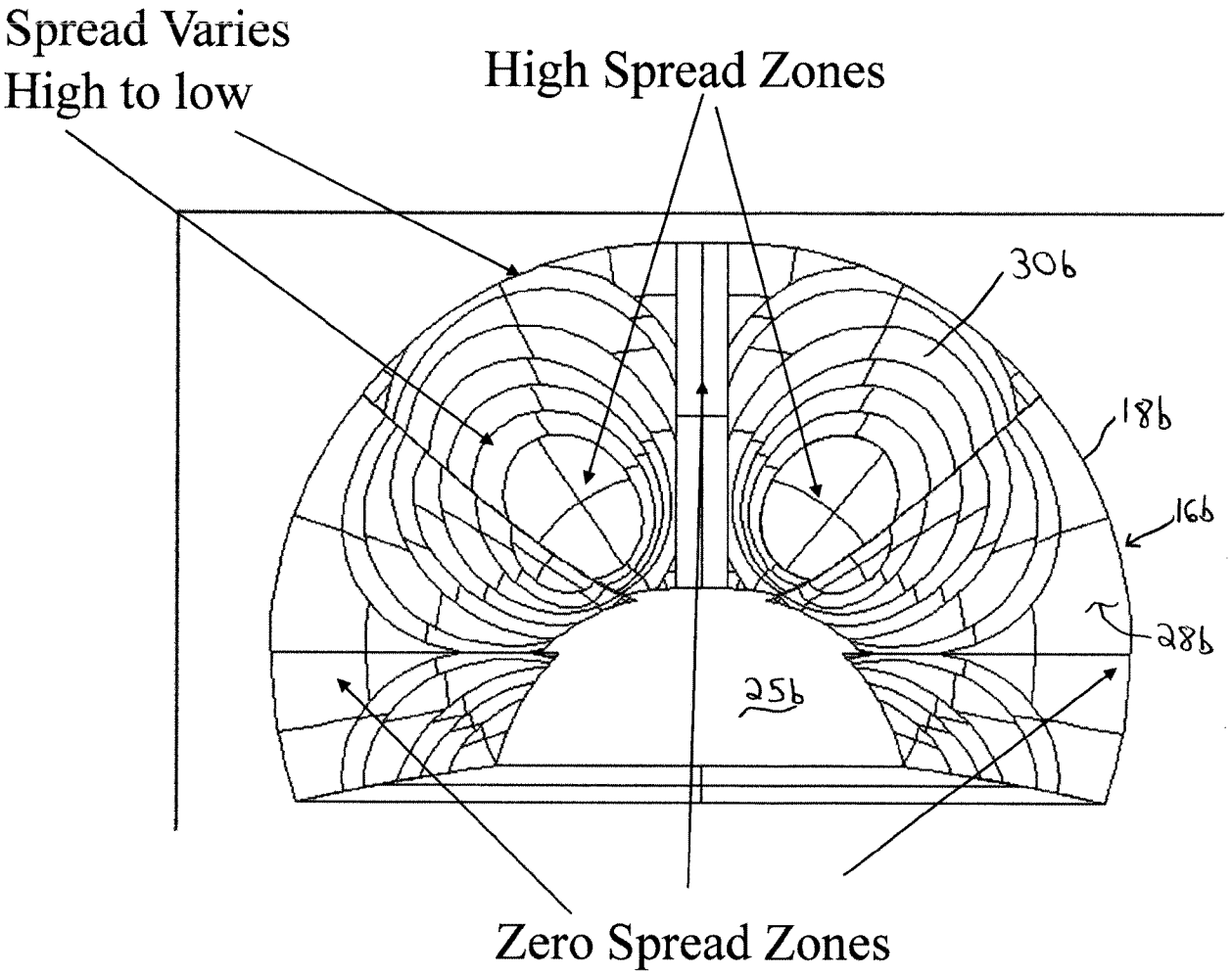
FIG. 5 is a front view of a portion of the series of reflectors of the dual beam headlamp assembly of FIG. 1.

Each of the arcuate shell portions 20*a*, 20*b* may generally be in the shape of a paraboloid. With reference to at least FIGS. 1 and 5, in the example embodiment, each of the shell portions 20*a*, 20*b* may take the shape of a semi-parabaloid. An inner surface 28*a*, 28*b* of the shell portions 20*a*, 20*b* may be generated by revolving a parabola around an axis 21*a*, 21*b*, respectively (FIGS. 3*a*, 4*a*), that is substantially parallel to the optical axis 11. Accordingly, the inner surface 28*a*, 28*b* of the shell portions 20*a*, 20*b* may be concave. With reference to at least FIG. 5, the inner surface 28*a*, 28*b* may include a series or array of variously-sized and shaped reflective elements 30*a*, 30*b*. The reflective elements 30*a*, 30*b* may be disposed at a variety of angles with respect to each other, such that light reflects from the reflective elements 30*a*, 30*b* in a variety of directions.

With reference to at least FIG. 2*a*, the illuminator subassembly 14 may include a mount or bracket 32, first and second light emitting devices or sources 34*a*, 34*b*, a brace or leg 36, and first and second lens 38*a*, 38*b*. As will be described in more detail below, the first light source 34*a*, the first lens 38*a*, and the first portion 16*a* of the reflector subassembly 12 may cooperate to form a low beam subsystem 39*a* (FIGS. 3*a*-3*e*) producing a low beam light pattern (FIGS. 8*a*, 8*b*, 8*c*). The second light source 34*b*, the second lens 38*b*, and the second portion 16*b* of the reflector subassembly 12 may cooperate to form a high beam subsystem 39*b* (FIGS. 4*a*-4*e*) producing a high beam light pattern (FIGS. 9*a*, 9*b*, 9*c*). In the example embodiment, and with respect to the frame of reference in FIG. 1, the low beam subsystem 39*a* may be located below the high beam subsystem 39*b*. In other embodiments, the low beam subsystem 39*a* may be located above the high beam subsystem 39*b*.

Figure 2B:
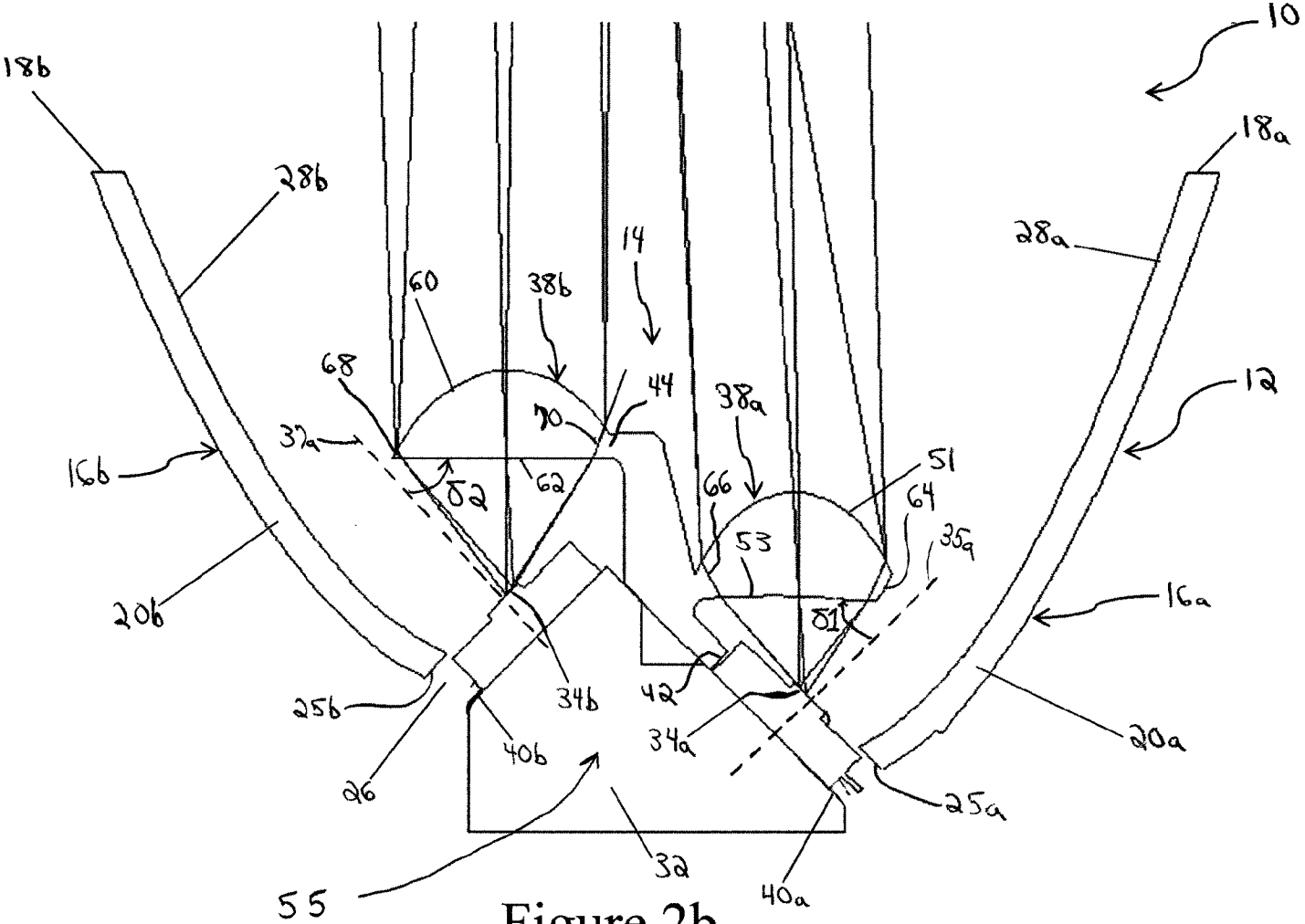

The bracket 32 may be mounted within the aperture 26 of the reflector subassembly 12 and may include a first mount surface 40*a* and second mount surface 40*b*. With reference to FIGS. 2*a* and 2*b*, in the example embodiment, the first and second mount surfaces 40*a*, 40*b* may substantially define a "V" shape, with the first mount surface 40*a* offset from the second mount surface 40*b* in a first direction X and angularly offset from the second mount surface by ninety (90) degrees. Similarly, the first and second mount surfaces 40*a*, 40*b* may each be offset from a horizontal plane by approximately forty-five (45) degrees. In other embodiments, the first mount surface 40*a* may be offset from the second mount surface 40*b* by ninety (90) degrees. The bracket 32 may also include other heat transferring features (e.g., fins) to transfer heat produced by the first and second light sources 34*a*, 34*b* out of the headlamp assembly 10.

With reference to FIGS. 2*a* and 2*b*, in the example embodiment of the headlamp assembly 10, the first and second light sources 34*a*, 34*b* may be light emitting diodes. In other embodiments, the first and second light sources 34*a*, 34*b* may be other flat, Lambertion light emitting devices. The first and second light sources 34*a*, 34*b* may be mounted to the bracket 32 and include a first light emitting surface 35 and a second light emitting surface 37, respectively. With particular reference to FIG. 2*a*, in the example embodiment, the normal 35*a*, 37*a* to the first and second light emitting surfaces 35, 37 is disposed at an angle $\alpha$ substantially equal to forty-five (45) degrees relative to the optical axis 11. It will be appreciated that the first and second light emitting surfaces 35, 37 may also be disposed at an angle substantially equal to one hundred thirty-five (135) degrees relative to the optical axis 11. In one configuration, the first light source 34*a* is fixed to the first mount surface 40*a* and the second light source 34*b* is fixed to the second mount surface 40*b*, such that the first light emitting surface 35 is offset from the second light emitting surface 37 (and the normal 35*a* to the first light emitting surface 35 is offset from the normal 37*a* to the second light emitting surface 37) by an angle $\beta$ substantially equal to ninety (90) degrees. Additionally, the normal 35*a*, 37*a* to the first and second light emitting surfaces 35, 37, respectively, is angularly offset from a horizontal plane by approximately forty-five (45) degrees.

The angular configuration of the first and second light emitting surfaces 35, 37, described above creates a dead zone, or a space in which no light is transmitted, opposite the first and second light emitting surfaces 35, 37, and substantially aligned with an apex 55 of the reflector subassembly 12 (FIG. 2*b*). The aperture 26, bracket 32 and leg 36 are located in this zone, or space, in which no light is transmitted. Accordingly, one hundred percent (100%) of the light emitted from the first and second light emitting surfaces 35, 37 is transmitted from the headlamp assembly 10 in a direction opposite the apex 55, and none of the light emitted from the first and second light emitting surfaces 35, 37 is blocked by, or otherwise transmitted into, the aperture 26, bracket 32 or leg 36.

With reference to FIG. 2*a*, the first light source 34*a* may be offset from the second light source 34*b* in the first direction X and a second direction Y (perpendicular to the first direction X). Angling and positioning the first and second light sources 34*a*, 34*b* in the manner described herein allows for close placement and proximity of the first and second lens 38*a*, 38*b* relative to the first and second light sources 34*a*, 34*b*, respectively. The close proximity of the first and second lens 38*a*, 38*b* relative to the first and second light sources 34*a*, 34*b*, ensures that the light reflected from the first and second portions 16*a*, 16*b* of the reflector subassembly 12 does not hit, or otherwise refract through, the first and second lens 38*a*, 38*b* prior to being transmitted from the headlamp assembly 10. The close proximity of the first and second lens 38*a*, 38*b* relative to the first and second light sources 34*a*, 34*b*, respectively, also allows the first and second lens to intercept and control one hundred percent (100%) of the light that is not reflected from the first and second portions 16*a*, 16*b* of the reflector subassembly 12.

Angling and positioning the first and second light sources 34*a*, 34*b* in the manner described herein also ensures that the spaces behind the first and second light sources 34*a*, 34*b* and between the first and second lens 38*a*, 38*b*, in which light is not emitted, are substantially aligned with the apex 55 of the reflector subassembly 12. As described above, the bracket 32, the leg 36, and other thermal management features (not shown) and lens support structures are located in this zone, or space, in order to ensure that they will not impact optical performance by blocking any of the light transmitted from the first and second light sources 34*a*, 34*b*. During operation of the headlamp assembly 10, described in more detail below, the arrangement described above creates a desirable mix of optical images.

The first and second lens 38*a*, 38*b* may be mounted within the headlamp assembly 10 using the leg 36. The leg 36 may include a first end 42 and a second end 44. The first end 42 may be mounted to the bracket 32. The second end 44 may be offset from the first end 42 in a direction substantially perpendicular to a horizontal plane and the optical axis 11.

The first lens 38*a* may be substantially shaped as an oblong and truncated hemisphere having an arcuate surface 51 and a substantially planar surface 53 opposite the arcuate surface. The planar surface 53 may face the first light source 34*a*. In the example embodiment, the first lens 38*a* may be formed from plastic. In other embodiments, the first lens 38*a* may be formed from a crystal, a glass, or another suitable composite. With reference to at least FIGS. 3*b*-3*e*, the first lens 38*a* may include a first segment 46, a second segment 48, and a third segment 50. The first segment 46 may be substantially identical to the third segment 50. Accordingly, like numerals will be used to identify like features on the first and third segments 46, 50. The first and third segments 46, 50 may each form a truncated spherical quadrant of the first lens 38*a*, and the second segment 48 may form a semi-cylindrical segment of the first lens 38*a*. The second segment 48 may be formed by extrusion and may be located between the first segment 46 and the third segment 50. The first and third segments 46, 50 may each include a truncated end 52 defining first and second planar surfaces 49*a*, 49*b* (FIG. 1), respectively. With reference to at least FIG. 3*b*, the truncated end 52 prevents the first lens 38*a* from blocking the light from the first light source 34*a*, such that the light from the first light source 34*a* reaches the rim portion 18*a* of the reflector subassembly 12.

Figure 3C:
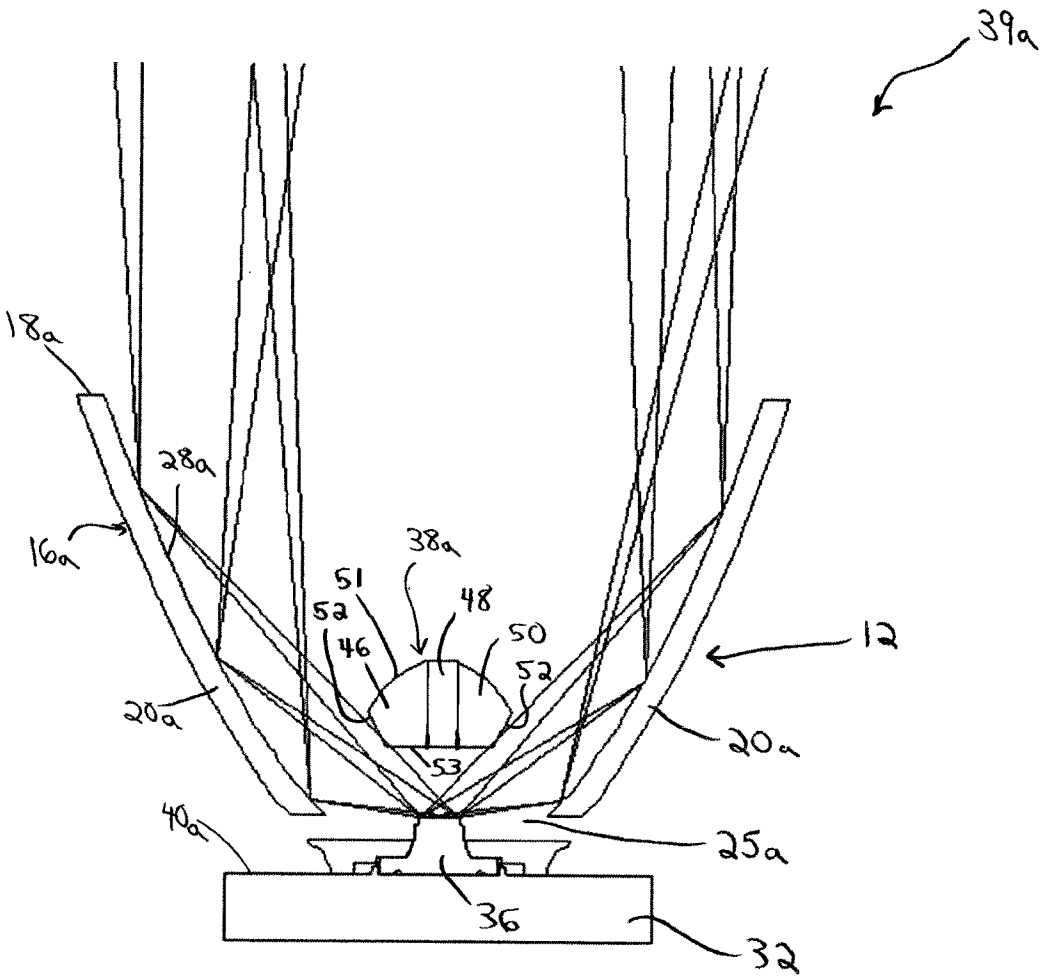
Figure 3D:
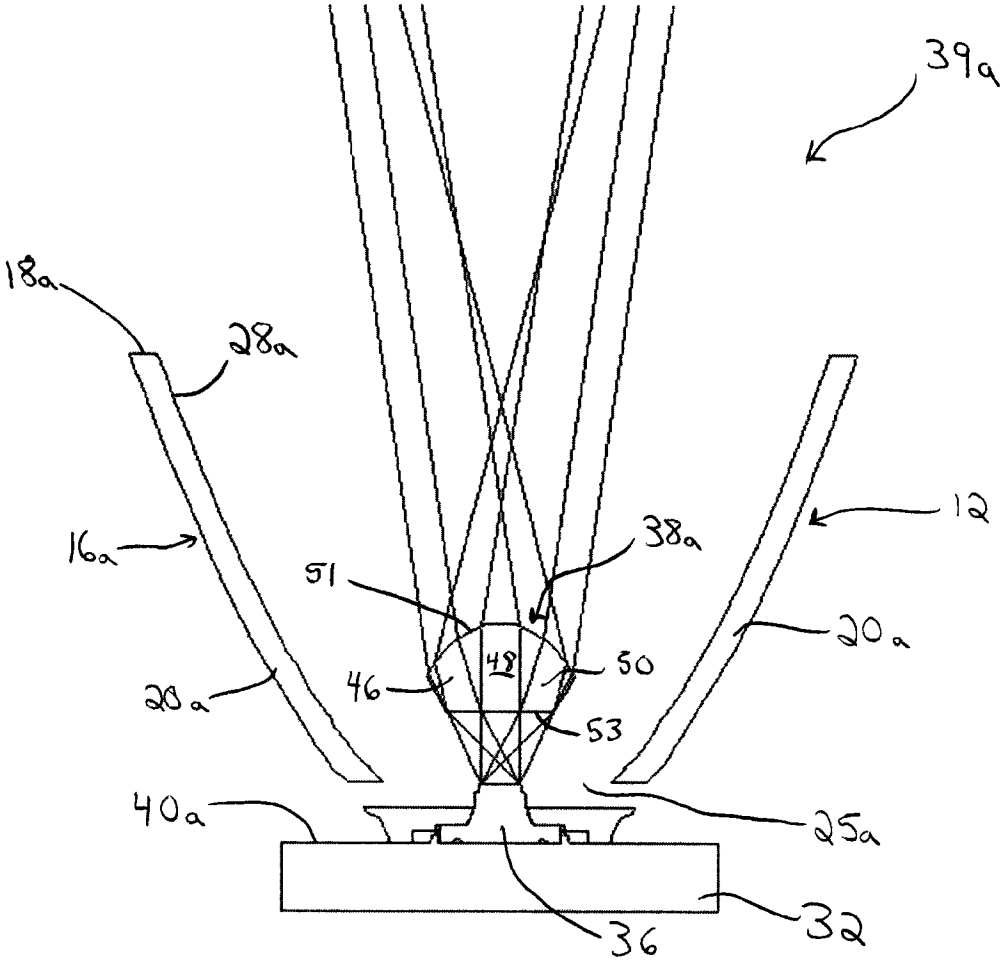
Figure 3E:
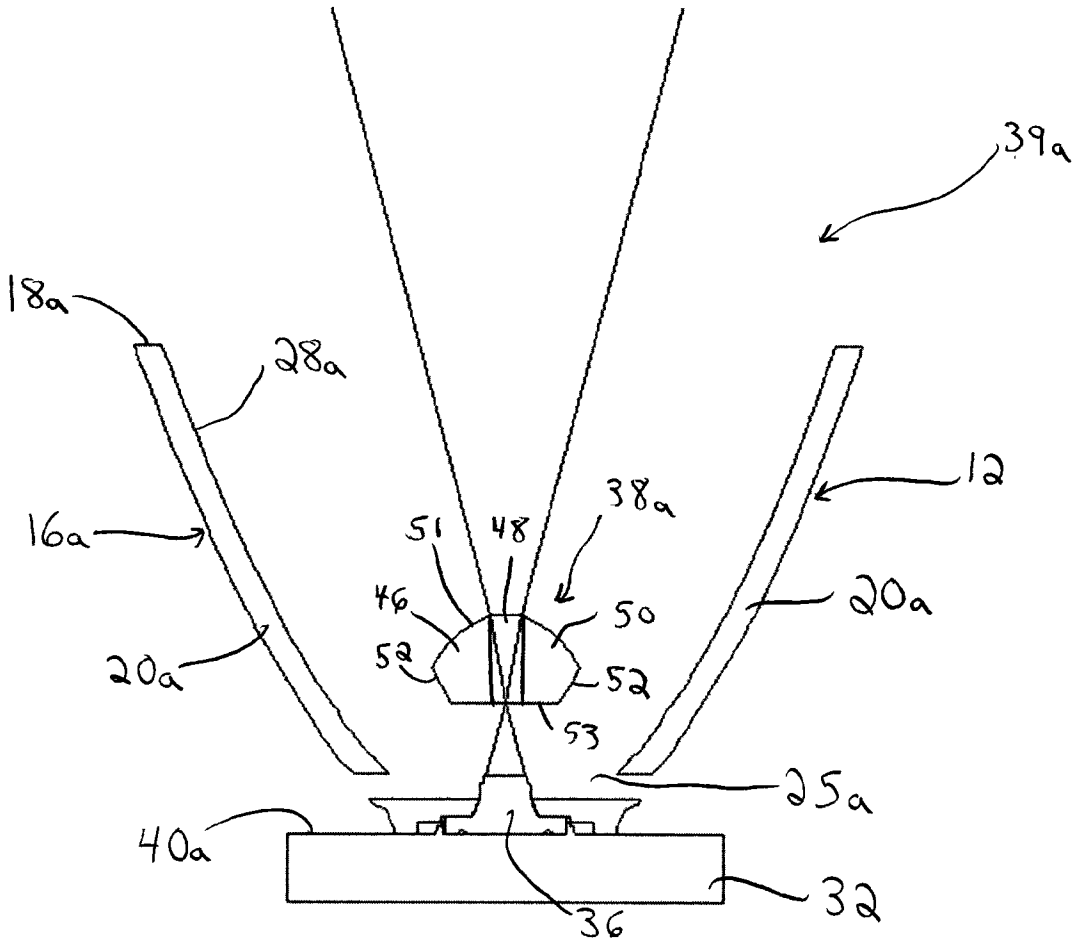

With reference to at least FIG. 3*d*, the first lens 38*a* may be arranged in the first portion 16*a* of the reflector subassembly 12 to receive a first portion of the light emitted from the first light source 34*a*. The first lens 38*a* may operate to direct the first portion of light in the forward direction along the optical axis 11. In the example embodiment, the first lens 38*a* may be mounted between the first end 42 and the second end 44 of the leg 36. The planar surface 53 of the lens 38*a* may be angularly offset from the normal 35*a* to the first light emitting surface 35 by an angle δ1 substantially equal to forty-five (45) degrees (FIG. 2*b*). The planar surface 53 may also form a ninety (90) degree angle with a horizontal plane and the optical axis 11.

With reference to FIGS. 4*b*-4*e*, the second lens 38*b* may include a first segment 54, a second segment 56, and a third segment 58. In the example embodiment, the second lens 38*b* may be formed from plastic. In other embodiments, the second lens 38*b* may be formed from a crystal, a glass, or another suitable composite. The first segment 54 may be substantially identical to the third segment 58. Accordingly, like numerals will be used to identify like features on the first and third segments 54, 58. The first and third segments 54, 58 may each be shaped as a quadrant of a sphere, such that the second lens 38*b* is substantially shaped as an oblong hemisphere having an arcuate surface and a substantially planar surface 62 opposite the arcuate surface. The planar surface 62 may face the second light source 34*b*. With particular reference to at least FIG. 4*b*, the second lens 38*b* may be located within the arcuate shell portion 20*b* of the reflector subassembly 12 such that the second lens 38*b* does not block or prevent the light from the second light source 34*b* from reaching the rim portion 18*b* of the reflector subassembly 12. The second segment 48 may be located between the first segment 54 and the third segment 58. The second segment 56 may be shaped as a semi-cylinder. The radius of the semi-cylindrical second segment 56 may be greater than the radius of the spherical quadrants formed by the first and third segments 54, 58, such that the an arcuate surface 60*a* of the second segment extends beyond, and is offset from, an arcuate surface 60*b* of the first and third segments 54, 58. The second segment 56 may be formed by extrusion.

The second lens 38*b* may be arranged in the second portion 16*b* of the reflector subassembly 12 to receive a first portion of the light emitted from the second light source 34*b*. The second lens 38*b* may operate to direct the first portion of light in the forward direction along the optical axis 11. In the example embodiment, the second lens 38*b* may be mounted to the second end 44 of the leg 36, such that the first lens 38*a* is located between the second lens 38*b* and the first end 42 of the leg 36, and offset from the first lens 38*a* in the first direction X and the second direction Y. The planar surface 62 of the second lens 38*b* may be angularly offset from the normal 37*a* to the second light emitting surface 37 by an angle δ1 substantially equal to forty-five (45) degrees (FIG. 2*b*). The planar surface 62 may also form a ninety (90) degree angle with a horizontal plane and the optical axis 11, and may be substantially parallel to the planar surface 53 of the first lens 38*a*.

When the first and second light sources 34*a*, 34*b* are illuminated, the profile of the first planar surface 53 of the first lens 38*a* and the profile of the second planar surface 62 of the second lens 38*b* may project back along the optical axis 11 in the direction of the first and second light sources, respectively. The size of the first and second lens 38*a*, 38*b*, and their proximity to the first and second light sources 34*a*, 34*b*, respectively, ensures that the aforementioned projected profile of the first and second lens 38*a*, 38*b* is substantially equal to the size of the aperture 26 and the size of the dead zone, or space, opposite the first and second light emitting surfaces 35, 37. Utilizing the correct optical prescription for the reflective elements 30*a*, 30*b*, and ensuring that the size of the projected profile of the first and second lens 38*a*, 38*b* is substantially equal to the size of the dead zone, ensures that the light from the reflector subassembly 12 does not interact or interfere with the optics on the first and second lens, while also ensuring that the first and second lens 38*a*, 38*b* and the reflector subassembly 12 only receive light directly from the first and second light sources 34*a*, 34*b*.

Operation of the headlamp assembly 10 will now be described in more detail. In the example embodiment, the first light source 34*a* cooperates with the first lens 38*a* and the first portion 16*a* of the reflector subassembly 12 to produce a low beam light pattern (FIGS. 8*a*, 8*b*, 8*c*), and the second light source 34*b* cooperates with the second lens 38*b* and the second portion 16*b* of the reflector subassembly 12 to produce a high beam light pattern (FIGS. 9*a*, 9*b*, 9*c*). When the first light source 34*a* is illuminated, a portion of the light may hit, and reflect from, the reflective elements 30*a* disposed on the first portion 16*a* of the reflector subassembly 12 (FIG. 2*a*, 3*c*). This portion of the light may produce a light pattern illustrated in FIG. 8*b*. Specifically, light reflecting from the reflective elements 30*a* positioned near the first light source 34*a* and/or the aperture 26 of the reflector subassembly 12 may produce tall images due to the relative proximity of the first light source 34*a* to the aperture 26. In addition, light reflecting from the reflective elements 30*a* positioned near the first light source 34*a* may produce a wide spread pattern due to the shape of the first portion 16*a* of the reflector subassembly 12, as described above. These tall images and the wide spread pattern can be seen at the left and right sides of the pattern illustrated in FIG. 8*b* (approximate x and y coordinates −40, −5 and 40, 5). Light reflecting from the reflective elements 30*a* positioned near the rim portion 18*a* of the reflector subassembly 12 may produce short images (i.e., a light pattern having a narrow spread and being tightly focused or concentrated), due to the relative distance of the first light source 34*a* from the rim portion 18*a*. These short images can be seen at the upper and central portions of the pattern illustrated in FIG. 8*b* (approximate x and y coordinates −10, 0 through 10, 0).

The remainder of the light produced by the first light source 34*a* may hit and refract through the first lens 38*a* (FIG. 2*b*). The remainder of the light may produce a light pattern illustrated in FIG. 8*a*. With reference to FIGS. 2*a* and 2*b*, due to the angular offset of the first light source 34*a* relative to the first lens 38*a*, described above, light transmitted or refracted through an upper portion or edge 64 (with respect to the frame of reference in FIG. 1) of the first lens 38*a* from the first light source 34*a* may produce tall images, while light transmitted through a lower portion or edge 66 of the first lens 38*a* from the first light source 34*a* may produce short images. The tall images can be seen near the lower portion of the pattern illustrated in FIG. 8*a* (approximate x and y coordinates −10, −10 through 10, −10). The short images can be seen near the upper portion of the pattern illustrated in FIG. 8*a* (approximate x and y coordinates −10, 0 through 10, 0). In addition, the light pattern transmitted by the second segment 48 of the first lens 38*a* may be characterized by a wide spread with a flat beam cutoff (FIG. 3*e*), while the light pattern transmitted by the first segment 46 and the third segment 50 of the first lens may be characterized by a more concentrated and tightly focused pattern (FIG. 3*d*). Prior to projecting from the headlamp assembly 10, one hundred percent (100%) of the light produced by the first light source 34*a* may contact the first lens 38*a* or the first portion 16*a* of the reflector subassembly 12, without contacting any additional portions or parts of the headlamp assembly 10.

When the second light source 34*b* is illuminated, a portion of the light may hit, and reflect from, the reflective elements 30*b* disposed on the second portion 16*b* of the reflector subassembly 12 (FIG. 2*a*). The portion of light may produce a light pattern illustrated in FIG. 9*b*. Specifically, light reflecting from the reflective elements 30*b* positioned near the second light source 34*b* and/or the aperture 26 of the reflector subassembly 12 may produce tall images due to the relative proximity of the second light source 34*b* to the aperture 26. In addition, light reflecting from the reflective elements 30*b* positioned near the second light source 34*b* may produce a wide spread pattern due to the shape of the second portion 16*b* of the reflector subassembly 12, as described above. These tall images and the wide spread pattern can be seen near the left and right sides, as well as the upper central portion, of the pattern illustrated in FIG. 9*b* (approximate x and y coordinates −10, 0 through 10, 0). Light reflecting from the reflective elements 30*b* positioned near the rim portion 18*b* of the reflector subassembly 12 may produce short images (i.e., a more tightly focused and narrower spread light pattern), due to the relative distance of the second light source 34*b* from the rim portion 18*b*. These short images can be seen near the lower central portion of the pattern illustrated in FIG. 9*b* (approximate x and y coordinates 0, 0).

Figure 4D:
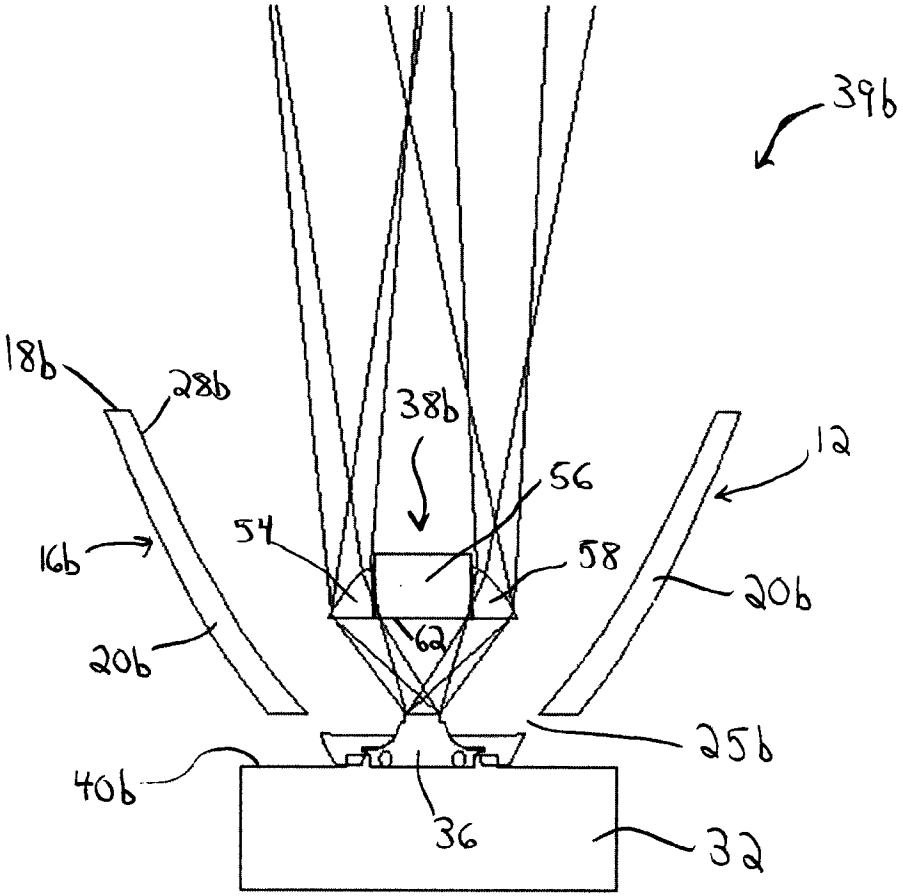
Figure 4E:
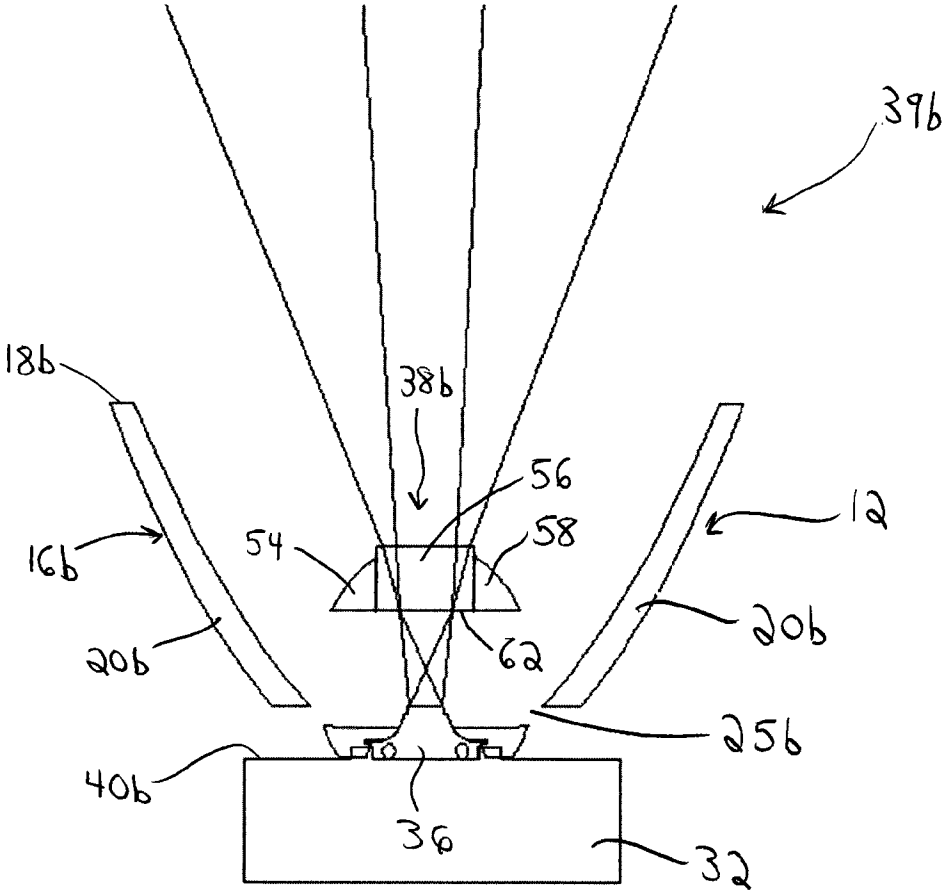

The remainder of the light produced by the second light source 34*b* may hit and refract through the second lens 38*b* (FIG. 2*b*). The remainder of the light may produce a light pattern illustrated in FIG. 9*a*. With reference to FIGS. 2*a* and 2*b*, due to the angular offset of the second light source 34*b* relative to the second lens 38*b*, described above, light transmitted or refracted through a lower portion or edge 68 (with respect to the frame of reference in FIG. 1) of the second lens 38*b* from the second light source 34*b* may produce tall images, while light transmitted through an upper portion or edge 70 of the second lens 38*b* from the second light source 34*b* may produce short images. The tall images can be seen near the left and right sides of the pattern illustrated in FIG. 9*a* (approximate x and y coordinates −25, −0 through −10, −00). The short images can be seen near the upper central and lower central portions of the pattern illustrated in FIG. 9*a* (approximate x and y coordinates −0, −2 through 0, 2). In addition, the light pattern transmitted by the second segment 56 of the second lens 38*b* may be characterized by a wide spread with a flat beam cutoff (FIG. 4*e*), while the light pattern transmitted by the first segment 54 and the third segment 58 of the second lens may be characterized by a more concentrated and tightly focused pattern (FIG. 4*d*). Prior to projecting from the headlamp assembly 10, one hundred percent (100%) of the light produced by the second light source 34*b* may contact the second lens 38*b* or the second portion 16*b* of the reflector subassembly 12, without contacting any additional portions or parts of the headlamp assembly 10.

Figure 6:
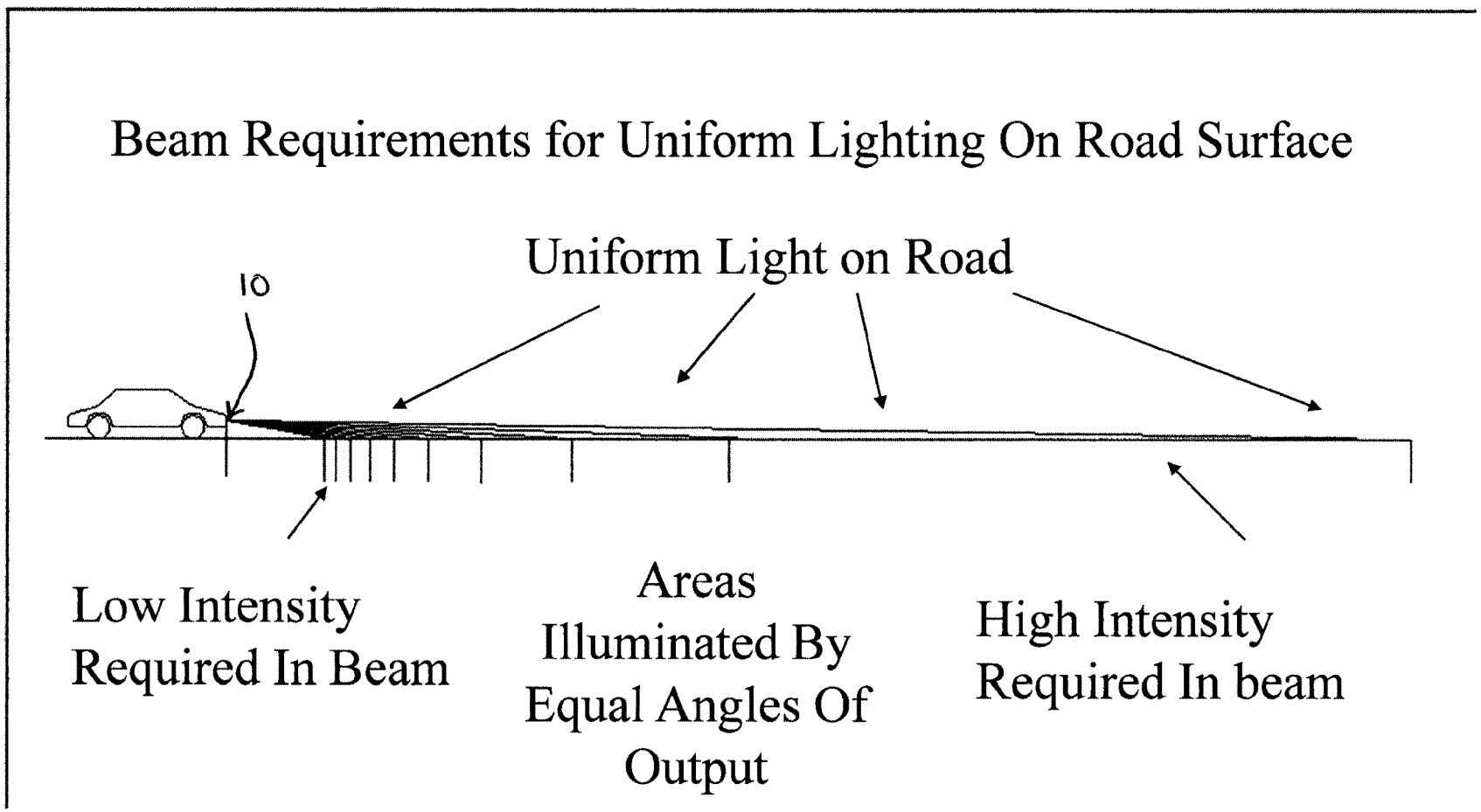
FIG. 6 is a schematic representation of the light produced by the dual beam headlamp assembly of FIG. 1.
Figure 7:
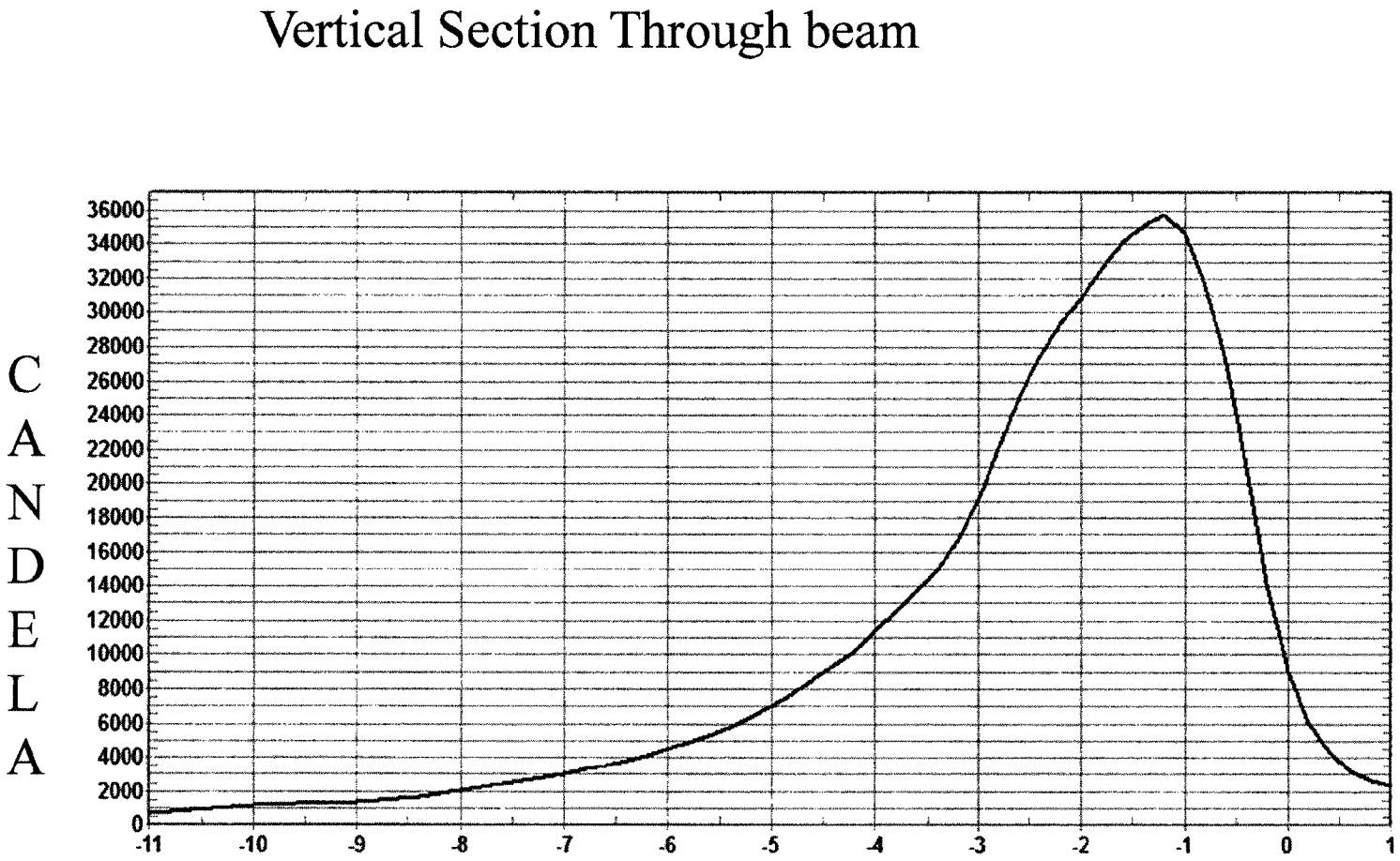
FIG. 7 is an illustration of the intensity of a vertical section of the light pattern produced by the dual beam headlamp assembly of FIG. 1.

By arranging the first and second light sources 34*a*, 34*b*, the first and second lens 38*a*, 38*b*, and the first and second portions 16*a*, 16*b* of the reflector subassembly 12 in the manner described above, the headlamp assembly 10 is able to produce the light pattern illustrated in FIG. 10, whereby the light produced by the first and second light sources 34*a*, 34*b* makes only a single contact with the reflective elements 30*a*, 30*b*, respectively, or the lens 38*a*, 38*b*, respectively, thus improving the efficiency of the headlamp assembly 10. The combined light pattern (FIG. 7 and FIG. 10) may be characterized by a wide and medium spread pattern from the reflective elements 30*a*, 30*b* located near the aperture 26 (producing the tall and vertical images described above), and a tightly focused pattern from the reflective elements 30*a*, 30*b* located near the rim portions 18*a*, 18*b* (producing the shorter and horizontal images described above). The combined light pattern may have a compact, nearly circular forward profile whereby the light pattern has equal angles of output, such that the headlamp assembly 10 creates a uniform lighting pattern on the road surface (FIG. 6). Specifically, low intensity light (characterized by the tall images described above) may be focused closer to the headlamp assembly 10 (close to the vehicle and the road surface near the vehicle, with reference to FIG. 6), while high intensity light (characterized by the short images described above) may be focused farther from the headlamp assembly 10 (far from the vehicle and the road surface far from the vehicle, with reference to FIG. 6).

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

What is claimed is:

1. A headlamp assembly operable to project light in a forward direction along an optical axis, the headlamp assembly comprising:

a housing;

a low beam light emitting device arranged in the housing and having a first planar surface from which light is emitted, the normal to the first planar surface of the low beam light emitting device being oriented away from the optical axis at substantially forty-five degrees in relation to the optical axis;

a high beam light emitting device arranged in the housing and having a second planar surface from which light is emitted, the normal to the second planar surface of the high beam light emitting device being oriented away from the optical axis at substantially forty-five degrees in relation to the optical axis and being oriented away from the normal to the first planar surface at substantially ninety degrees;

a low beam lens arranged in the housing to receive a portion of the light emitted from the low beam light emitting device and operable to direct the light in the forward direction along the optical axis;

a high beam lens arranged in the housing to receive a portion of the light emitted from the high beam light emitting device and operable to direct the light in the forward direction along the optical axis; and a reflector arranged in the housing to receive a remaining portion of the light emitted from the low beam light emitting device and a remaining portion of the high beam light emitting device and reflect the remaining portions of the light in the forward direction along the optical axis.

2. The headlamp assembly of claim 1 wherein the reflector includes a low beam portion and a high beam portion, wherein the low beam portion is positioned above the low beam lens and the low beam light emitting device in relation to the optical axis and has a reflecting surface with a shape obtained by revolving a parabola ninety degrees around its axis, and wherein the high beam portion is positioned below the high beam lens and the high beam light emitting device in relation to the optical axis and has a reflecting surface with a shape obtained by revolving a parabola ninety degrees around its axis.

3. The headlamp assembly of claim 1 wherein the reflector includes a low beam portion having a plurality of reflecting surfaces and a high beam portion having a plurality of reflecting surface, each reflecting surface having a parabolic shape.

4. The headlamp assembly of claim 1 wherein the low beam light emitting device and the high beam light emitting device are further defined as a light emitting diodes.

5. The headlamp assembly of claim 1, wherein the low beam lens includes a first planar lens surface and the high beam lens includes a second planar lens surface, and wherein the first planar lens surface is oriented from the first planar surface of the low beam light source at substantially forty-five degrees, and the emitting device planar lens surface is oriented from the second planar surface of the high beam light source at substantially forty-five degrees.

6. The headlamp assembly of claim 1, further comprising a leg, wherein the low beam lens is mounted to a first side of the leg and the high beam lens is mounted to a second side of the leg, opposite the first side, and wherein the low beam lens includes a first segment, a second segment, and a third segment, and wherein the first segment, the second segment, and the third segment substantially define a portion of a sphere having a first truncated end and a second truncated end opposite the first truncated end.

7. The headlamp assembly of claim 6, wherein the high beam lens includes a first segment having a first arcuate surface, a second segment having a second arcuate surface, and a third segment disposed between the first segment and the second segment, and wherein the third segment is substantially semi-cylindrical in shape and includes a third arcuate surface that is offset from the first arcuate surface and the second arcuate surface.

8. The headlamp assembly of claim 1, further comprising a bracket, the bracket including a first mount surface and a second mount surface, wherein an angle between the first mount surface and the second mount surface is substantially equal to ninety degrees, and wherein the low beam light emitting device is disposed on the first mount surface and the low beam light emitting device is disposed on the second mount surface.

9. The headlamp assembly of claim 1, wherein the reflector includes a low beam portion and a high beam portion, and wherein the low beam portion and the high beam portion substantially form the shape of a confocal parabolic cylinder.

10. The headlamp assembly of claim 9, wherein the low beam portion and the high beam portion of the reflector define an aperture therebetween.

11. The headlamp assembly of claim 10, wherein the low beam light emitting device and the high beam light emitting device are disposed substantially within the aperture.

12. A headlamp assembly operable to project light in a forward direction along an optical axis, the headlamp assembly comprising:

a housing defining an aperture therein;

a low beam light emitting device arranged in the housing and having a planar surface from which light is emitted;

a low beam lens arranged in the housing to receive a portion of the light emitted from the low beam light emitting device and operable to direct the light in the forward direction along the optical axis;

a high beam light emitting device arranged in the housing and having a planar surface from which light is emitted;

a high beam lens arranged in the housing to receive a portion of the light emitted from the high beam light emitting device and operable to direct the light in the forward direction along the optical axis;

a reflector arranged in the housing to receive a remaining portion of the light emitted from the low beam light emitting device and a remaining portion of the light from the high beam light emitting device and reflect the remaining portions of the light in the forward direction along the optical axis, where the normal to the planar surface of the low beam light emitting device is orientated in relation to the normal of the planar surface of the high beam light emitting device in a manner that creates a space within the housing in which light from the low beam light emitting device and from the high beam light emitting device does not pass through; and a bracket disposed in the space, wherein the low beam lens and the high beam lens are attached to the bracket.

13. The headlamp assembly of claim 12 wherein the reflector is configured such that light is only reflected once off a surface thereof.

14. The headlamp assembly of claim 12 wherein the reflector includes a low beam portion and a high beam portion, wherein the low beam portion is positioned above the low beam lens and the low beam light emitting device in relation to the optical axis and has a reflecting surface with a shape obtained by revolving a parabola ninety degrees around its axis, and wherein the high beam portion is positioned below the high beam lens and the high beam light emitting device in relation to the optical axis and has a reflecting surface with a shape obtained by revolving a parabola ninety degrees around its axis.

15. The headlamp assembly of claim 14 wherein the low beam portion of the reflector has a plurality of reflecting surfaces, such that each reflecting surface has a different focal point on the planar surface of the low beam light emitting device and the high beam portion of the reflector has a plurality of reflecting surfaces, such that each reflecting surface has a different focal point on the planar surface of the high beam light emitting device.

16. The headlamp assembly of claim 12 wherein the low beam light emitting device and the high beam light emitting device are further defined as a light emitting diodes.

17. The headlamp assembly of claim 16 wherein the flat surface of the low beam lens is oriented at substantially forty-five degrees in relation to the planar surface of the low beam light emitting device, and the flat surface of the high beam lens is oriented at substantially forty-five degrees in relation to the planar surface of the high beam light emitting device.

18. The headlamp assembly of claim 17 wherein the low beam lens is formed in shape of a cylinder cut in half along a longitudinal axis thereof to define a flat surface opposing a curved surface, such that the flat surface is arranged to receive the portion of the light emitted from the low beam light emitting device, and the high beam lens is formed in shape of a cylinder cut in half along a longitudinal axis thereof to define a flat surface opposing a curved surface, such that the flat surface is arranged to receive the portion of the light emitted from the high beam light emitting device.

19. The headlamp assembly of claim 12 wherein the low beam light emitting device and the high beam light emitting device are disposed substantially in the space.

20. A headlamp assembly operable to project light in a forward direction along an optical axis, comprising:

a housing;

a low beam light emitting device arranged in the housing and having a first planar surface from which light is emitted, the normal to the first planar surface of the low beam light emitting device being oriented away from the optical axis at an acute angle in relation to the optical axis;

a high beam light emitting device arranged in the housing and having a second planar surface from which light is emitted, the normal to the second planar surface of the high beam light emitting device being oriented away from the optical axis at an acute angle in relation to the optical axis and being oriented away from the normal to the first planar surface at substantially ninety degrees;

a low beam lens arranged in the housing to receive a portion of the light emitted from the low beam light emitting device and operable to direct the light in the forward direction along the optical axis;

a high beam lens arranged in the housing to receive a portion of the light emitted from the high beam light emitting device and operable to direct the light in the forward direction along the optical axis;

a reflector arranged in the housing to receive a remaining portion of the light emitted from the low beam light emitting device and a remaining portion of the high beam light emitting device and reflect the remaining portions of the light in the forward direction along the optical axis, wherein the low beam lens is arranged in relation to the reflector such that the remaining portions of the light reflected by the reflector is not incident upon the surface of the low beam lens and the high beam lens is arranged in relation to the reflector such that the remaining portions of the light reflected by the reflector is not incident upon the surface of the high beam lens; and a bracket supporting the low beam lens and the high beam lens within the housing, where the normal to the planar surface of the low beam light emitting device is orientated in relation to the normal of the planar surface of the high beam light emitting device in a manner that creates a space within the housing in which light from the low beam light emitting device and from the high beam light emitting device does not pass through and the bracket is disposed in the space.

* * * * *